US009463858B1

(12) United States Patent
Remmers et al.

(10) Patent No.: US 9,463,858 B1
(45) Date of Patent: Oct. 11, 2016

(54) METHOD AND SYSTEM FOR CONTROLLING A TRIM POSITION OF A MARINE PROPULSION UNIT

(71) Applicant: BRP US INC., Sturtevant, WI (US)

(72) Inventors: Gregry Remmers, Ingleside, IL (US); Philip Bylsma, Brookfield, WI (US)

(73) Assignee: BRP US INC., Sturtevant, WI (US)

( * ) Notice: Subject to any disclaimer, the term of this patent is extended or adjusted under 35 U.S.C. 154(b) by 129 days.

(21) Appl. No.: 14/556,749

(22) Filed: Dec. 1, 2014

Related U.S. Application Data

(60) Provisional application No. 61/910,245, filed on Nov. 29, 2013.

(51) Int. Cl.

| | |
|---|---|
| ***B63H 20/08*** | (2006.01) |
| ***B63H 20/10*** | (2006.01) |
| ***B63H 21/30*** | (2006.01) |
| ***B63H 20/00*** | (2006.01) |
| ***B63H 20/12*** | (2006.01) |

(52) U.S. Cl.
CPC ..... *B63H 20/10* (2013.01); *B63H 20/12* (2013.01); *B63H 21/265* (2013.01); *B63H 21/30* (2013.01)

(58) Field of Classification Search
CPC ..... B63H 20/08; B63H 25/02; B63H 20/10; B63H 21/265
See application file for complete search history.

(56) References Cited

U.S. PATENT DOCUMENTS

| | | | | |
|---|---|---|---|---|
| 3,906,885 | A * | 9/1975 | Woodfill | B63H 11/113 440/41 |
| 4,318,699 | A | 3/1982 | Wenstadt et al. | |
| 4,861,292 | A | 8/1989 | Griffiths et al. | |
| 4,939,660 | A | 7/1990 | Newman et al. | |
| 5,366,393 | A * | 11/1994 | Uenage | B63H 20/10 440/1 |
| 6,149,476 | A | 11/2000 | Eilert | |
| 7,416,456 | B1 | 8/2008 | Gonring et al. | |
| 7,736,206 | B1 | 6/2010 | McChesney et al. | |
| 8,216,007 | B2 | 7/2012 | Moore | |
| 2004/0106337 | A1* | 6/2004 | Okabe | B63H 20/08 440/61 S |
| 2007/0077829 | A1* | 4/2007 | Boning | B63B 39/061 440/1 |
| 2008/0161985 | A1* | 7/2008 | Hallstensson | B63B 1/22 701/21 |
| 2008/0182463 | A1* | 7/2008 | St-Pierre | B63H 11/113 440/1 |
| 2010/0030410 | A1* | 2/2010 | Faller | B63H 5/125 701/21 |
| 2011/0143608 | A1* | 6/2011 | Chiecchi | B63B 39/061 440/53 |
| 2011/0151732 | A1* | 6/2011 | Chiecchi | B63B 39/061 440/84 |
| 2011/0217886 | A1* | 9/2011 | Kuriyagawa | B63H 21/21 440/1 |
| 2011/0263167 | A1* | 10/2011 | Chiecchi | B63H 5/125 440/53 |

* cited by examiner

*Primary Examiner* — Khoi Tran
*Assistant Examiner* — Ryan Rink
(74) *Attorney, Agent, or Firm* — BCF LLP

(57) ABSTRACT

A method for controlling a trim position of a marine propulsion unit for propelling a watercraft has the steps of: sensing an engine speed; positioning the propulsion unit at a first trim angle when the engine speed is less than or equal to a first predetermined engine speed, the first trim angle being constant; positioning the propulsion unit at a second trim angle when the engine speed is greater than the first predetermined engine speed and less than the second predetermined engine speed; and positioning the propulsion unit at a third trim angle when the engine speed is greater than or equal to the second predetermined engine speed, the third trim angle being constant. A system for controlling a trim position of a marine propulsion unit for propelling a watercraft is also disclosed.

24 Claims, 13 Drawing Sheets

METHOD AND SYSTEM FOR CONTROLLING A TRIM POSITION OF A MARINE PROPULSION UNIT

CROSS-REFERENCE

The present application claims priority to U.S. Provisional Patent Application No. 61/910,245, filed Nov. 29, 2013, the entirety of which is incorporated herein by reference.

FIELD OF TECHNOLOGY

The present technology relates to a method and system for controlling a trim position of a marine propulsion unit.

BACKGROUND

A marine outboard engine generally comprises a bracket assembly that connects the drive unit of the marine outboard engine to the stern of a boat. The drive unit includes an internal combustion engine and a propulsion unit having a propeller. The marine outboard engine is typically designed so that the steering angle and the tilt/trim angles of the drive unit relative to the boat can be adjusted and modified as desired. The bracket assembly typically includes a swivel bracket carrying the drive unit for pivotal movement about a steering axis and a stern bracket supporting the swivel bracket and the drive unit for pivotal movement about a tilt/trim axis extending generally horizontally. The stern bracket is connected to the stern of the boat.

The drive unit's trim angle, and therefore the propulsion unit's drive system, can have a significant effect on a boat's hydrodynamic properties, and hence also have an effect on the engine's performance. When at low speed, the boat sits deep in the water, and is kept afloat by buoyancy. As speed increases, so does the hydrodynamic lift force of the water against the hull. When at a high enough speed, and with a properly trimmed propulsion unit, a boat can get to an "on plane" condition where the boat skims over the surface of the water (i.e. planes) and thereby creates less hydrodynamic drag. Properly trimming the drive unit can allow the boat to cruise at a desired speed at a lower engine speed than if the drive unit is not properly trimmed. Also, properly trimming the drive unit can allow a higher top speed to be reached.

When at cruising speed, trimming in raises the stern and pushes the bow down, while trimming out lowers the stern and raises the bow. When the drive unit is trimmed too far in, the bow ploughs into the water, displacing more water than necessary, thereby increasing drag and slowing the boat. This condition can also create undesirable additional splashing of water by the bow. When the drive unit is trimmed too far out, the stern can be pushed too deep into the water, again increasing drag and slowing the boat. This can also lead to undesirable porpoising where the bow of the watercraft cyclically rises above the water and then dives into the water. Also, should the drive unit be trimmed out to the point where the propeller is no longer submerged in the water, an undesirable condition called "ventilation" occurs that can cause a loss of power and can cause the engine to rapidly increase in speed.

As such, in addition to having to control the steering direction and throttle of an outboard engine, the driver of a boat has to control a trim position of the propulsion unit in order to obtain optimal performance from the outboard engine. Although many boat drivers like to control the trim themselves, other drivers may desire not to have to worry about the trim and focus on steering and throttle.

Therefore there is a need for a method and a system for controlling a trim position of a marine propulsion unit without a direct input of the driver of the boat.

SUMMARY

It is an object of the present technology to ameliorate at least some of the inconveniences present in the prior art.

According to one implementation of the present technology, there is provided a method for controlling a trim position of a marine propulsion unit for propelling a watercraft. The marine propulsion unit is driven by an engine. The method comprises: sensing an engine speed; positioning the propulsion unit at a first trim angle when the engine speed is less than or equal to a first predetermined engine speed, the first trim angle being constant; determining a second trim angle at which the propulsion unit is to be positioned when the engine speed is greater than the first predetermined engine speed and less than a second predetermined engine speed, the second trim angle increasing as the engine speed increases, the second trim angle being determined independently of a speed of the watercraft, the second trim angle being greater than the first trim angle, the second predetermined engine speed being greater than the first predetermined engine speed; positioning the propulsion unit at the second trim angle when the engine speed is greater than the first predetermined engine speed and less than the second predetermined engine speed; and positioning the propulsion unit at a third trim angle when the engine speed is greater than or equal to the second predetermined engine speed, the third trim angle being constant, the third trim angle being greater than the second trim angle.

In some implementations of the present technology, the first trim angle is a full trim in angle.

In some implementations of the present technology, the third trim angle is less than a full trim out angle.

In some implementations of the present technology, a difference between the second predetermined engine speed and the first predetermined engine speed is less than the first predetermined engine speed.

In some implementations of the present technology, positioning the propulsion unit at the third trim angle when the engine speed is greater than or equal to the second predetermined engine speed includes: positioning the propulsion unit at the third trim angle when the engine speed is greater than or equal to the second predetermined engine speed and less than or equal to a third predetermined engine speed. The third predetermined engine speed is greater than the second predetermined engine speed. The method further comprises: positioning the propulsion unit at a fourth trim angle when the engine speed is greater than the third predetermined engine speed and less than a fourth predetermined engine speed. The fourth trim angle increasing as the engine speed increases. The fourth trim angle is independent of the speed of the watercraft. The fourth trim angle is greater than the third trim angle.

In some implementations of the present technology, the method further comprises positioning the propulsion unit at a fifth trim angle when the engine speed is greater than or equal to the fourth predetermined engine speed. The fifth trim angle is constant. The fifth trim angle is greater than the fourth trim angle.

In some implementations of the present technology, the first trim angle is a full trim in angle.

In some implementations of the present technology, the fifth trim angle is less than a full trim out angle.

In some implementations of the present technology, the fifth trim angle is at an angle from the full trim in angle corresponding to 25 percent of a difference between the full trim out angle and the full trim in angle.

In some implementations of the present technology, a difference between the fourth predetermined engine speed and the first predetermined engine speed is less than the first predetermined engine speed.

In some implementations of the present technology, a difference between the third predetermined engine speed and the second predetermined engine speed is less than a difference between the second predetermined engine speed and the first predetermined engine speed.

In some implementations of the present technology, a difference between the third predetermined engine speed and the second predetermined engine speed is less than a difference between the fourth predetermined engine speed and the third predetermined engine speed.

In some implementations of the present technology, the method further comprises sensing a throttle position. The first predetermined engine speed has a first value when the throttle position is less than a first predetermined throttle position and has a second value when the throttle position is greater than the first predetermined throttle position, the first value being less than the second value.

In some implementations of the present technology, the second predetermined engine speed varies based on the throttle position.

In some implementations of the present technology, the first trim angle is constant, the second trim angle is greater than the first trim angle, the second predetermined engine speed is greater than the first predetermined engine speed, the third trim angle is constant, and the third trim angle is greater than the second trim angle for a constant throttle position.

In some implementations of the present technology, the method further comprises determining if a trim assist mode has been entered; controlling the trim position of the marine propulsion unit in the trim assist mode when the trim assist mode has been entered, controlling the trim position of the marine propulsion unit in the trim assist mode including the steps of sensing the engine speed, positioning the propulsion unit at the first trim angle, determining the second trim angle, positioning the propulsion unit at the second trim angle, and positioning the propulsion unit at the third trim angle; and controlling the trim position of the marine propulsion unit in a manual trim mode when the trim assist mode has not been entered, controlling the trim position of the marine propulsion unit in the manual trim mode including changing the trim angle of the marine propulsion unit based on at least one signal received from at least one trim controller.

In some implementations of the present technology, the method further comprises switching from controlling the trim position of the marine propulsion unit in the trim assist mode to controlling the trim position of the marine propulsion unit in the manual trim mode when the at least one signal is received from the at least one trim controller while in the trim assist mode.

In some implementations of the present technology, after switching from controlling the trim position of the marine propulsion unit in the trim assist mode to controlling the trim position of the marine propulsion unit in the manual trim mode when the at least one signal is received from the at least one trim controller while in the trim assist mode, the trim position of the marine propulsion unit continues to be controlled in the manual trim mode until the trim assist mode is entered again.

In some implementations of the present technology, the method further comprises: sensing a throttle position; and positioning the propulsion unit at a fourth trim angle when the engine speed is greater than a third predetermined and the throttle position is less than a predetermined throttle position, the fourth trim angle generally decreasing as the engine speed increases. A trim angle of the propulsion unit generally increases as the engine speed increases when the engine speed is greater than the third predetermined and the throttle position is greater than the predetermined throttle position.

According to another aspect of the present technology, there is provided a system for controlling a trim position of a marine propulsion unit for propelling a watercraft. The marine propulsion unit is driven by an engine. The unit has a trim actuator adapted to be operatively connected to the marine propulsion unit; a control unit electronically connected to the trim actuator for controlling the trim actuator; and an engine speed sensor electronically connected to the control unit, the engine speed sensor sensing an engine speed. The control unit controls the trim actuator to: position the propulsion unit at a first trim angle when the engine speed sensed by the engine speed sensor is less than or equal to a first predetermined engine speed, the first trim angle being constant; position the propulsion unit at a second trim angle when the engine speed sensed by the engine speed sensor is greater than the first predetermined engine speed and less than a second predetermined engine speed, the second trim angle increasing as the engine speed increases, the second trim angle being determined by the control unit based on engine speed and independently of a speed of the watercraft, the second trim angle being greater than the first trim angle, the second predetermined engine speed being greater than the first predetermined engine speed; and position the propulsion unit at a third trim angle when the engine speed sensed by the engine speed sensor is greater than or equal to the second predetermined engine speed, the third trim angle being constant, the third trim angle being greater than the second trim angle.

In some implementations of the present technology, a trim angle sensor is electronically connected to the control unit. The trim angle sensor senses a trim angle of the marine propulsion unit.

In some implementations of the present technology, the first trim angle is a full trim in angle.

In some implementations of the present technology, the third trim angle is less than a full trim out angle.

In some implementations of the present technology, the control unit controls the trim actuator to: position the propulsion unit at the third trim angle when the engine speed sensed by the engine speed sensor is greater than or equal to the second predetermined engine speed and less than or equal to a third predetermined engine speed, the third predetermined engine speed being greater than the second predetermined engine speed; position the propulsion unit at a fourth trim angle when the engine speed sensed by the engine speed sensor is greater than the third predetermined engine speed and less than a fourth predetermined engine speed, the fourth trim angle increasing as the engine speed increases, the fourth trim angle being independent of the speed of the watercraft, the fourth trim angle being greater than the third trim angle; and position the propulsion unit at a fifth trim angle when the engine speed sensed by the engine speed sensor is greater than or equal to the fourth predetermined engine speed, the fifth trim angle being constant, the fifth trim angle being greater than the fourth trim angle.

For purposes of this application, the terms related to spatial orientation such as forward, rearward, left, right, vertical, and horizontal are as they would normally be understood by a driver of a boat sitting thereon in a normal driving position with a marine propulsion unit mounted to a stern of the boat. Also, the term "trim in" refers to pivoting the marine propulsion unit about a horizontal tilt/trim axis toward the watercraft to which the marine propulsion unit is connected and the term "trim out" refers to pivoting the marine propulsion unit about the horizontal tilt/trim axis away from the watercraft.

Implementations of the present technology each have at least one of the above-mentioned aspects, but do not necessarily have all of them. It should be understood that some aspects of the present technology that have resulted from attempting to attain the above-mentioned object may not satisfy this object and/or may satisfy other objects not specifically recited herein.

Additional and/or alternative features, aspects, and advantages of implementations of the present technology will become apparent from the following description, the accompanying drawings, and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

DETAILED DESCRIPTION

The present method and system will be described with respect to a marine outboard engine. However, it is contemplated that aspects of the present technology could be used with other marine engines, such as, for example, a stern drive which has a propulsion system mounted to a stern of a watercraft that is driven by an engine disposed inside the watercraft. Also, in an outboard engine, the drive unit is tilted and trimmed with the propulsion unit; as such drive unit tilting or trimming and propulsion unit tilting or trimming are used interchangeably herein. In the case of a stern drive for example, only the propulsion unit is tilted and trimmed, as such the indication of the drive unit being tilted or trimmed herein, when applied to a stern drive, should be understood as only the propulsion unit of the stern drive being tilted or trimmed.

Figure 1:
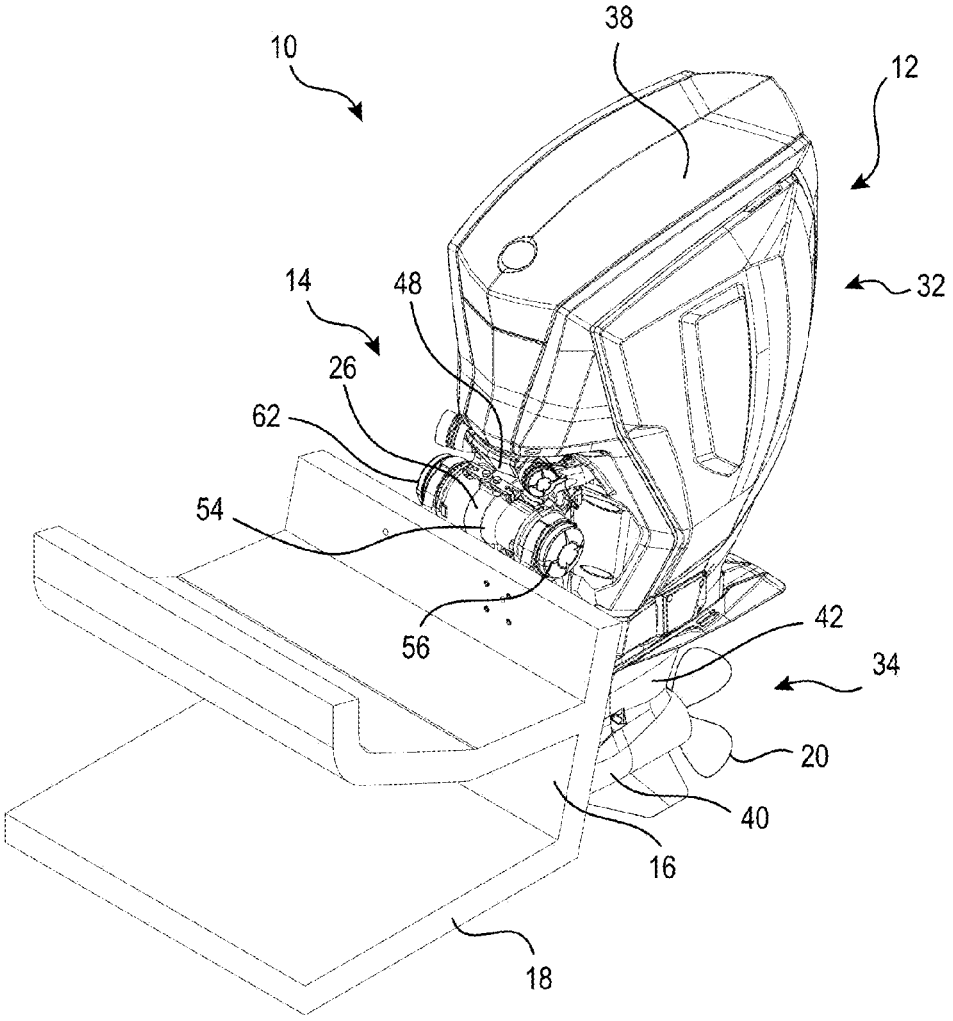
FIG. 1 is a perspective view taken from a front, left side of a marine outboard engine mounted in an upright position to a stern of watercraft.

With reference to FIGS. 1 to 5, a marine outboard engine 10, shown in the upright position, includes a drive unit 12 and a bracket assembly 14. The bracket assembly 14 supports the drive unit 12 on a stern 16 of a hull 18 of an associated watercraft (not shown). The drive unit 12 can be pivoted about a generally horizontal tilt/trim axis 24 relative to the hull 18 and the transom 16 between a full trim in position (see FIG. 2) and a tilted out position (see FIG. 5). This range of motion is divided into a range of trim angles, wherein a propeller 20 is in a submerged position, and a range of tilt angles, over which the propeller 20 is lifted above the water line for trailering, for example. The boundaries of the range of trim angles are the full trim in position and a full trim out position (see FIG. 4). The boundaries of the range of tilt angles are the full trim out position and the tilted out position. The drive unit 12 is moved about the tilt/trim axis 24 by two linear actuators 22 (only one of which is shown) and by a rotary actuator 26 of the bracket assembly 14. The drive unit 12 can also be tilted out (see FIG. 5) or in relative to the hull 18 by the rotary actuator 26 of the bracket assembly 14 about the tilt/trim axis 24. The drive unit 12 can also be steered left or right relative to the hull 18 by another rotary actuator 28 of the bracket assembly 14 about a steering axis 30. The steering axis 30 extends generally perpendicularly to the tilt/trim axis 24. When the drive unit 12 is in the upright position as shown in FIG. 1, the steering axis 30 extends generally vertically. The actuators 22, 26 and 28 are hydraulic actuators. The actuators 22, 26 and 28 and their operation will be discussed in greater detail below. It is contemplated that the actuators 22, 26 and 28 could be other types of actuators of another type, such as for example, electrical actuators.

The drive unit 12 includes an upper portion 32 and a lower portion 34. The upper portion 32 includes an engine 36 (schematically shown in dotted lines in FIG. 3) surrounded and protected by a cowling 38. The engine 36 housed within the cowling 38 is an internal combustion engine, such as a two-stroke or four-stroke engine, having cylinders extending horizontally. It is contemplated that other types of engine could be used and that the cylinders could be oriented differently. The lower portion 34 includes a propulsion unit 40, also known as the gear case assembly, which includes the propeller 20, and a connection portion 42, which extends from the upper portion 32 to the gear case assembly 40.

Figure 3:
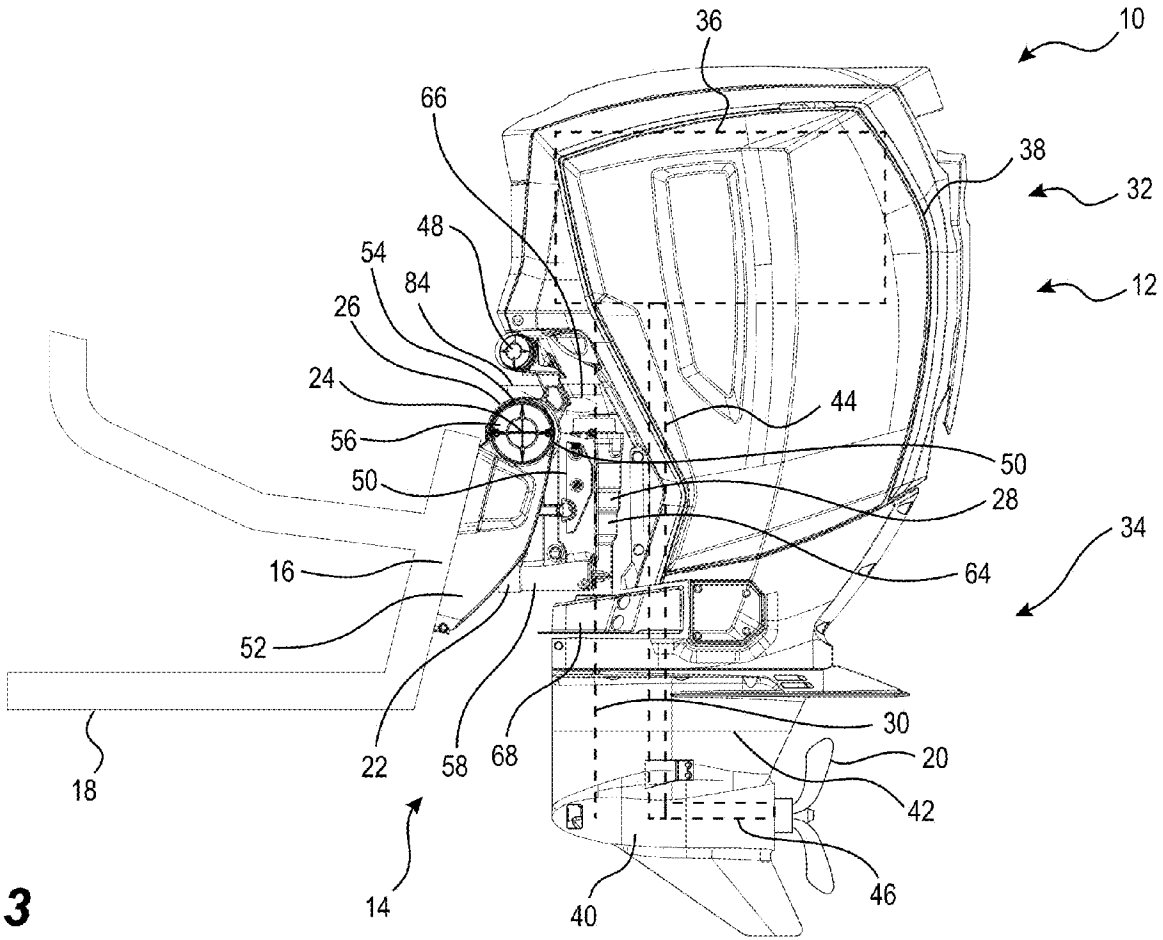
FIG. 3 is a left side elevation view of the outboard engine of FIG. 1 trimmed at a maximum trim angle of a trim assist mode of operation of the outboard engine.

The engine 36 is coupled to a driveshaft 44 (schematically shown in dotted lines in FIG. 3). When the drive unit 12 is in the upright position as shown in FIG. 1, the driveshaft 44 is oriented vertically. It is contemplated that the driveshaft 44 could be oriented differently relative to the engine 34. The driveshaft 44 is coupled to a transmission (not shown) which is coupled to a propeller shaft 46 (FIG. 3) on which the propeller 20 is mounted. In the present implementation, the propeller shaft 46 is perpendicular to the driveshaft 44; however it is contemplated that it could be at other angles. The driveshaft 44, the transmission and the propeller shaft 46 transfer the power of the engine 36 to the propeller 20 disposed at the rear of the propulsion unit 40 of the drive unit 12. It is contemplated that the propulsion unit of the outboard engine 10 could alternatively include a jet propulsion device, turbine or other known propelling device.

To facilitate the installation of the outboard engine 10 on the watercraft, the outboard engine 10 is provided with a box 48. The box 48 is connected on top of the rotary actuator 26. As a result, the box 48 pivots about the tilt/trim axis 24 when the outboard engine 10 is tilted, but does not pivot about the steering axis 30 when the outboard engine 10 is steered. It is contemplated that the box 48 could be mounted elsewhere on the bracket assembly 14 or on the drive unit 12. Devices located inside the cowling 38 which need to be connected to other devices disposed externally of the outboard engine 10, such as on the deck or hull 18 of the watercraft, are provided with lines which extend inside the box 48. In one implementation, these lines are installed in and routed to the box 48 by the manufacturer of the outboard engine 10 during manufacturing of the outboard engine 10. Similarly, the corresponding devices disposed externally of the outboard engine 10 are also provided with lines that extend inside the box 48 where they are connected with their corresponding lines from the outboard engine 10. It is contemplated that one or more lines could be connected between one or more devices located inside the cowling 38 to one or more devices located externally of the outboard engine 10 and simply pass through the box 48. In such an implementation, the box 48 would reduce movement of the one or more lines when the outboard engine 10 is steered, tilted or trimmed.

Other known components of an engine assembly are included within the cowling 38, such as a starter motor, an alternator and the exhaust system. As it is believed that these components would be readily recognized by one of ordinary skill in the art, further explanation and description of these components will not be provided herein.

The bracket assembly 14 will now be described in more detail. The bracket assembly 14 includes a swivel bracket 50 pivotally connected to a stern bracket 52 via the rotary actuator 26. The stern bracket 52 includes a plurality of holes and slots (not shown) adapted to receive fasteners (not shown) used to fasten the bracket assembly 14 to the stern 16 of the watercraft. By providing many holes and slots, the vertical position of the stern bracket 50, and therefore the bracket assembly 14, relative to the stern 16 can be adjusted.

The rotary actuator 26 includes a cylindrical main body 54, a central shaft (not shown) disposed inside the main body 54 and protruding from the ends thereof, and a piston (not shown) surrounding the central shaft and disposed inside the main body 54. The main body 54 is located at an upper end of the swivel bracket 50 and is integrally formed therewith. It is contemplated that the main body 54 could be fastened, welded, or otherwise connected to the swivel bracket 50. The central shaft is coaxial with the tilt/trim axis 24. Splined disks (not shown) are provided over the portions of the central shaft that protrude from the main body 54. The splined disks are connected to the central shaft so as to be rotationally fixed relative to the central shaft. The stern bracket 52 has splined openings at the upper end thereof that receive the splined disks therein. As a result, the stern bracket 52, the splined disks and the central shaft are all rotationally fixed relative to each other. Anchoring end portions 56 are fastened to the sides of the stern bracket 52 over the splined openings thereof and the ends of the central shaft, thus preventing lateral displacement of the swivel bracket 50 relative to the stern bracket 52.

The piston is engaged to the central shaft via oblique spline teeth on the central shaft and matching splines on the inside diameter of the piston. The piston is slidably engaged to the inside wall of the cylindrical main body 54 via longitudinal splined teeth on the outer diameter of the piston and matching splines on the inside diameter of the main body 54. By applying pressure on the piston, by supplying hydraulic fluid inside the main body 54 on one side of the piston, the piston slides along the central shaft. Since the central shaft is rotationally fixed relative to the stern bracket 52, the oblique spline teeth cause the piston, and therefore the main body 54 (due to the longitudinal spline teeth), to pivot about the central shaft and the tilt/trim axis 24. The connection between the main body 54 and the swivel bracket 50 causes the swivel bracket 50 to pivot about the tilt/trim axis 24 together with the main body 54. Supplying hydraulic fluid to one side of the piston causes the swivel bracket 50 to pivot away from the stern bracket 52 (i.e. tilt out). Supplying hydraulic fluid to the other side of the piston causes the swivel bracket 50 to pivot toward the stern bracket 52 (i.e. tilt in). U.S. Pat. No. 7,736,206 B1, issued Jun. 15, 2010, the entirety of which is incorporated herein by reference, provides additional details regarding rotary actuators similar in construction to the rotary actuator 26. It is contemplated that the rotary actuator 26 could be replaced by one or more linear actuators.

To mechanically block the swivel bracket 50 in the tilted out position (shown in FIG. 5), which is the position that the swivel bracket 50 is typically kept at when the watercraft is in storage or on a trailer, the bracket assembly 14 is provided with a locking arm (not shown) pivotally connected to the swivel bracket 50. To use the locking arm, the swivel bracket 50 is pivoted upwards to the tilted out position and the locking arm is pivoted to its locking position where it makes contact with the stern bracket 52. The locking arm thus alleviates stress on the rotary actuator 26 and its associated hydraulic components during storage or transport on a trailer.

The linear actuators 22 each include a cylinder 58, a piston (not shown) disposed inside the cylinder 58, and a rod 60 connected to the piston and protruding from the cylinder 58. As can be seen, the cylinders 58 are located at a lower end of the swivel bracket 50. The cylinders 58 are integrally formed with the swivel bracket 50 and the lines which supply them with hydraulic fluid are formed thereby. It is contemplated that the cylinders 58 could alternatively be fastened, welded, or otherwise connected to the swivel bracket 50. The rods 60 extend generally perpendicularly to the tilt/trim axis 24 and to the steering axis 30. It is contemplated that the hydraulic linear actuators 22 could be replaced by other types of linear actuators having a fixed portion connected to the swivel bracket 50 and a movable portion being extendable and retractable linearly relative to the fixed portion. A shaft (not shown) with rollers 62 (FIG.

5) thereon extends from the rod 60 of the left actuator 22 to the rod 60 of the right actuator 22. The rollers 62 are made of stainless steel, but other materials, such as plastics, are contemplated.

By supplying hydraulic fluid inside the cylinders 58 on the side of the pistons opposite the side from which the rods 60 extend, the pistons slide inside the cylinders 58. This causes the rods 60 to extend further from the cylinders 58 and the rollers 62 to roll along and push against curved surfaces formed by ramps (not shown) connected to the stern bracket 52. The ramps are fastened to the back of the stern bracket 52. It is contemplated that the ramps could be welded to the stern bracket 52, integrally formed with the stern bracket 52, or otherwise connected to the stern bracket 52. As the rods 60 extend from their respective cylinders 58, the rollers roll down along the curved surfaces of the ramps. As the rollers roll down along the curved surfaces of the ramps, they move away from the stern bracket 52 due to the profile of the surfaces of the ramps. As a result of the rods 60 extending from the cylinders 58 and the rollers 62 rolling along the surfaces the ramps, the swivel bracket 50 pivots away from the stern bracket 52 (i.e. trims out) about the tilt/trim axis 24 up to the angle shown in FIG. 4 where the rods 60 are fully extended.

Figure 4:
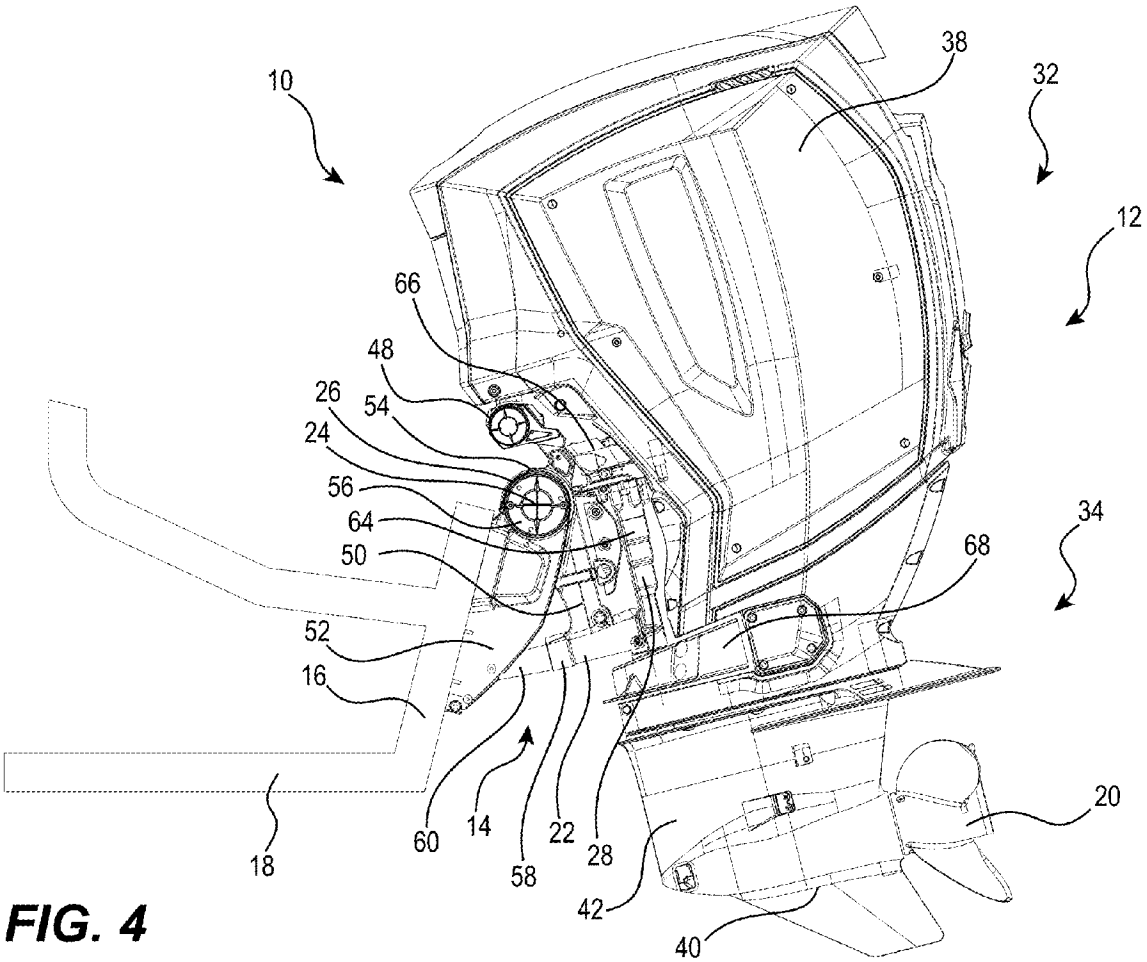
FIG. 4 is a left side elevation view of the outboard engine of FIG. 1 trimmed at a full trim out angle.
Figure 5:
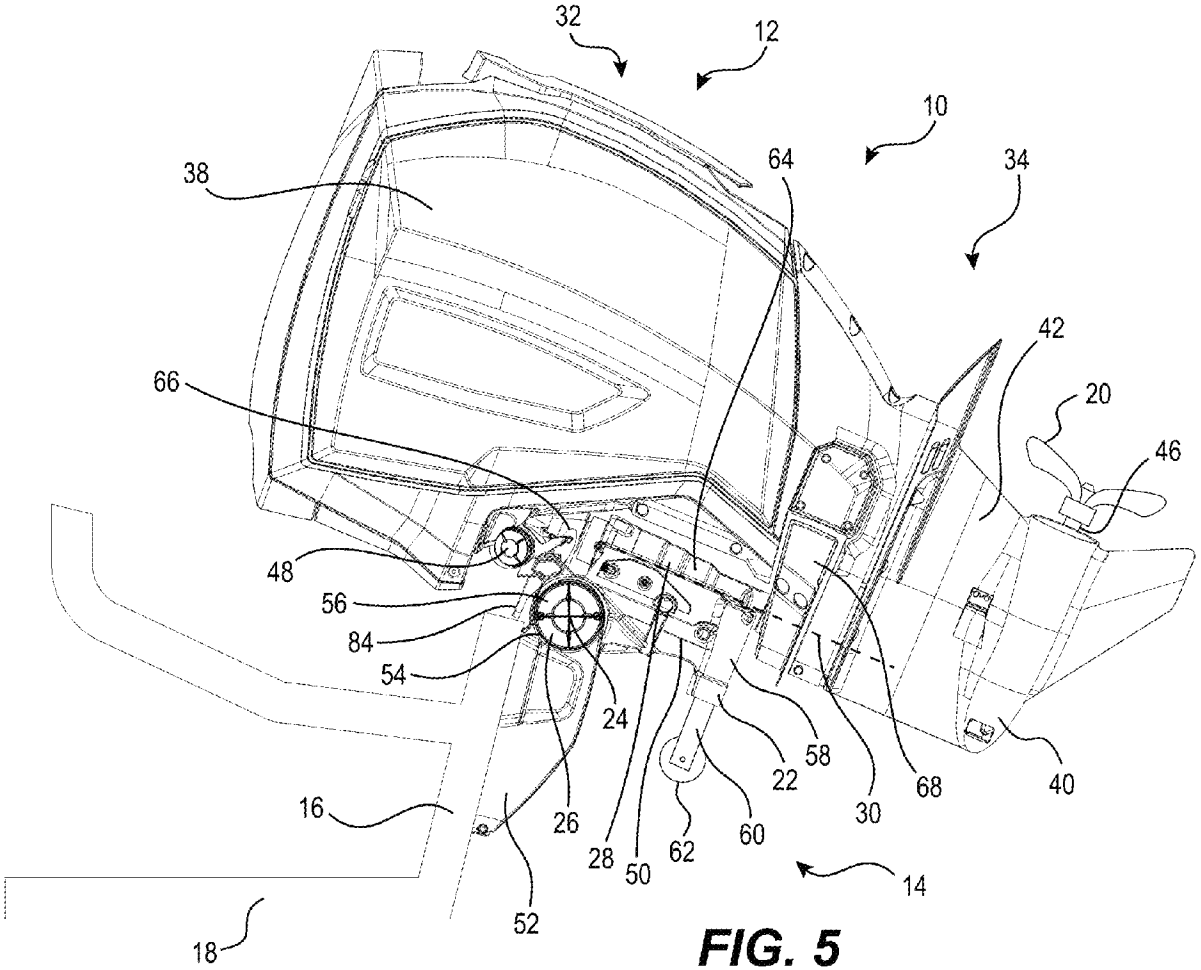
FIG. 5 is a left side elevation view of the outboard engine of FIG. 1 in a tilted out position.

In one exemplary implementation, the swivel bracket 50 pivots by 21 degrees from its full trim in position (i.e. the position shown in FIG. 2) to its full trim out position shown in FIG. 4. It is contemplated that this angle could be between 15 and 30 degrees. Once this angle is reached, should further pivoting of the swivel bracket 50 relative to the stern bracket 52 (i.e. tilt) be desired, the rotary actuator 26 provides the pivoting motion up to the angle shown in FIG. 5. As can be seen in FIG. 5, the rollers 62 no longer make contact with the stern bracket 52. To pivot the swivel bracket 50 back toward the stern bracket 52 (i.e. trim in) about the tilt/trim axis 24 from the position shown in FIG. 4, the hydraulic fluid can be actively removed from the cylinders 58 (i.e. pumped out), or can be pushed out of the cylinders 58 by the pistons due to the weight of the swivel bracket 50 and the drive unit 12 pushing toward the stern bracket 52. The movement achieved by the linear actuators 22 is known as trim as they allow for precise angular adjustment of the swivel bracket 50 relative to the stern bracket 52, and therefore of the propulsion unit 40, at a slower angular speed than that provided by the rotary actuator 26. It is however contemplated that the linear actuators 22 could be omitted such that the rotary actuator 26 is solely responsible for the trim and tilt movements of the swivel bracket 50.

Similarly to the rotary actuator 26, the rotary actuator 28 includes a cylindrical main body 64, a central shaft (not shown) disposed inside the main body 64 and protruding from the ends thereof and a piston (not shown) surrounding the central shaft and disposed inside the main body 64. The main body 64 is centrally located along the swivel bracket 50 and is integrally formed therewith. It is contemplated that the main body 64 could be fastened, welded, or otherwise connected to the swivel bracket 50. The central shaft is coaxial with the steering axis 30. Splined disks (not shown) are provided over the portions of the central shaft that protrude from the main body 64. The splined disks are connected to the central shaft so as to be rotationally fixed relative to the central shaft. An upper generally U-shaped drive unit mounting bracket 66 has a splined opening therein that receives the upper splined disk therein. Similarly, a lower generally U-shaped drive unit mounting bracket 68 has a splined opening therein that receives the lower splined disk therein. The upper and lower drive unit mounting brackets 66, 68 are fastened to the drive unit 12 so as to support the drive unit 12 onto the bracket assembly 14. As a result, the drive unit 12, the splined disks and the central shaft are all rotationally fixed relative to each other. Anchoring end portions (not shown) are fastened to the upper and lower drive unit mounting brackets 66, 68 over the splined openings thereof and the ends of the central shaft, thus preventing displacement of the drive unit 12 axially along the steering axis 30.

The piston is engaged to the central shaft via oblique spline teeth on the central shaft and matching splines on the inside diameter of the piston. The piston is slidably engaged to the inside wall of the cylindrical main body 64 via longitudinal splined teeth on the outer diameter of the piston and matching splines on the inside diameter of the main body 64. By supplying hydraulic fluid inside the main body 64 on one side of the piston, the piston slides along the central shaft. Since the main body 64 is rotationally fixed relative to the swivel bracket 50, the oblique spline teeth cause the central shaft and therefore the upper and lower drive unit mounting brackets 66, 68, to pivot about the steering axis 30. The connections between the drive unit 12 and the upper and lower drive unit mounting brackets 66, 68 cause the drive unit 12 to pivot about the steering axis 30 together with the central shaft. Supplying hydraulic fluid to one side of the piston causes the drive unit 12 to steer left. Supplying hydraulic fluid to the other side of the piston causes the drive unit 12 to steer right. U.S. Pat. No. 7,736,206 B1, issued Jun. 15, 2010, provides additional details regarding rotary actuators similar in construction to the rotary actuator 28. It is contemplated that the rotary actuator 28 could be replaced by one or more linear actuators.

To supply hydraulic fluid to the rotary actuators 26, 28 and the linear actuators 22, the bracket assembly 14 is provided with pumps 70, 72 (FIG. 6) each connected to a plurality of valves (not shown) and a hydraulic fluid reservoir (not shown). It is contemplated that there could be more than one pump 70 and more than one pump 72. The pumps 70, 72 are mounted to the swivel bracket 50 so as to pivot together with the swivel bracket 50 about the tilt-trim axis 24. It is contemplated that in some alternative implementations of the present bracket assembly 14, that the pumps 70, 72 could be mounted to the stern bracket 52 or inside the watercraft instead.

The pumps 70, 72 are bi-directional electric pumps, meaning that the direction of the flow of hydraulic fluid from each pump 70, 72 can be changed by changing the direction of rotation of their respective motors. It is contemplated that the pumps 70, 72 could be unidirectional pumps, in which case it is contemplated that a system of valves could be used to vary the direction of the flow or that the pumps 70, 72 could cause flow of hydraulic fluid in one direction and that additional pumps could cause flow of hydraulic fluid in the other direction. It is also contemplated that other types of pumps could be used, such as, for example, axial flow pumps or reciprocating pumps.

The pump 70 supplies hydraulic fluid to the trim actuators 22 and to the tilt actuator 26 to cause trim and tilt of the drive unit 12. It should be noted that, as the swivel bracket 50 is being trimmed out or in by the linear actuators 22, fluid is being simultaneously supplied to the rotary actuator 26 to obtain the same amount of angular movement in the same direction and at the same rate. The pump 72 supplies hydraulic fluid to the steering actuator 28 to cause steering of the drive unit 12.

Figure 6:
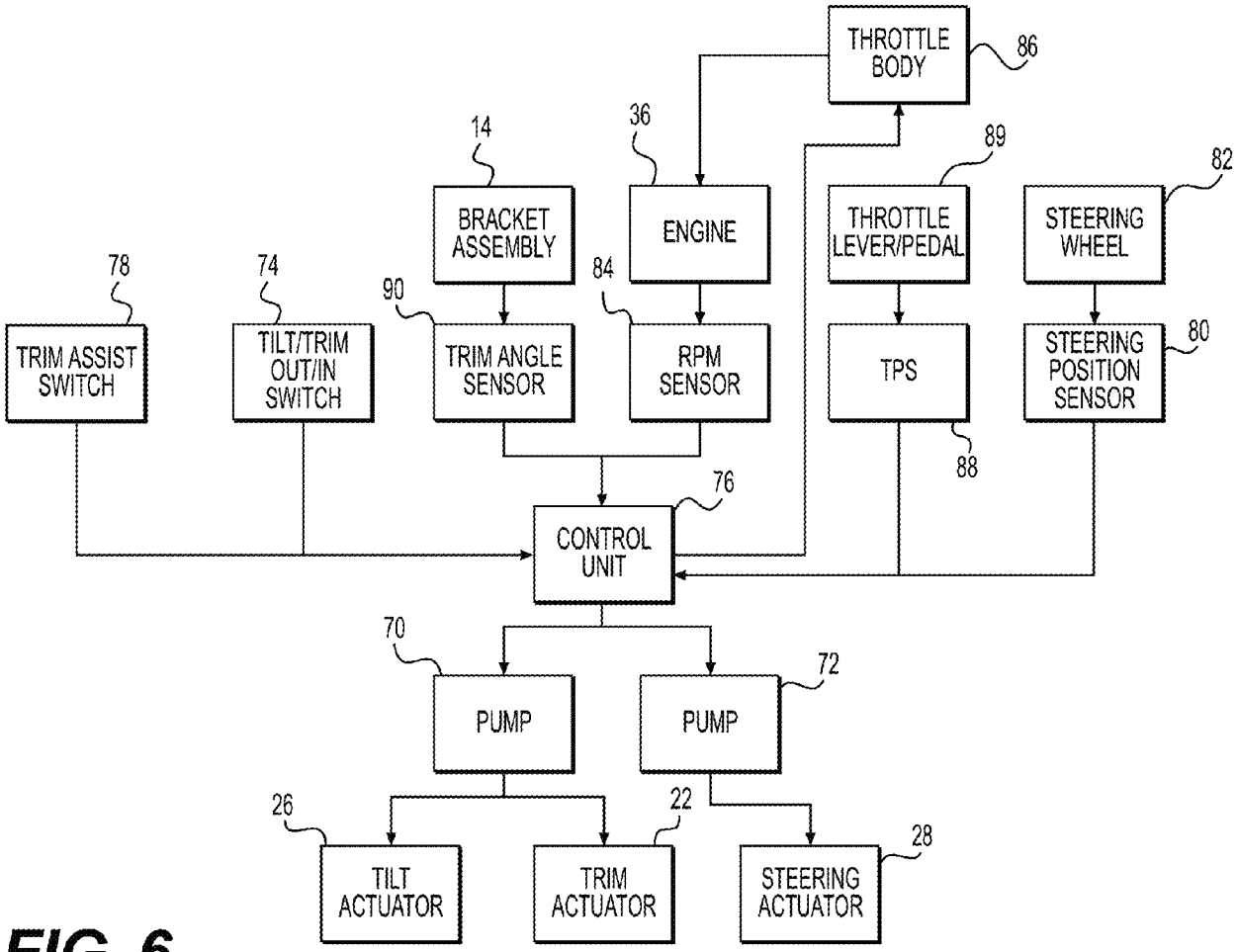
FIG. 6 is a schematic representations of various components of the outboard engine of FIG. 1.

The pump 70 is actuated in response to the actuation by the driver of the watercraft of tilt/trim controller, which in the present implementation is a tilt/trim out/in switch 74. Actuation of the switch 74 sends a signal to a control unit 76 that then sends an appropriate signal to the pump 70. The control unit 76 is disposed inside the cowling 38, but it is contemplated that it could be located elsewhere. Actuation of the switch 74 to one position causes the pump 70 to supply hydraulic fluid to trim actuators 22 and the tilt actuator 26 to cause the actuators 22, 26 to pivot the drive unit 12 away from the stern 16 of the watercraft (i.e. out). Actuation of the switch 74 to another position causes the pump 70 to supply hydraulic fluid to the trim actuators 22 and the tilt actuator 26 to cause the actuators 22, 26 to pivot the drive unit 12 toward the stern 16 of the watercraft (i.e. in). It is contemplated that the switch 74 could be replaced by separate switches or buttons for the in and out movement and/or for separating the trim and tilt movements (i.e. a trim controller and a tilt controller). It is also contemplated that the switch 74 could be replaced by, but not limited to, one or more levers or icons on a touchscreen. As will be explained in greater detail below, the pump 70 can also be controlled automatically by the control unit 76 to automatically adjust a trim of the drive unit 12 when the driver actuates a trim assist switch 78 (FIG. 6). It is contemplated that the trim assist switch 78 could be, but not limited to, multiple switches or one or more of buttons, levers, or icons on a touchscreen or gauges.

The pump 72 is actuated in response to signals received by the control unit 76 from a steering position sensor 80 (FIG. 6). The steering position sensor 80 reads a position of the steering wheel 82 (FIG. 6) of the watercraft and sends a corresponding signal to the control unit 76. The control unit 76 then sends an appropriate signal to the pump 72 to actuate the steering actuator 28 in order to steer the drive unit 12 in the proper direction. It is contemplated that the pump 72 and the steering position sensor 80 could be omitted in which case the steering actuator 28 is connected to the steering wheel 82 by a hydraulic system to directly hydraulically actuate the steering actuator 28 in response to movement of the steering wheel 82. It is also contemplated that the pump 72, the steering position sensor 80, and the steering actuator 28 could be omitted in which case the steering wheel 82 could be mechanically connected to the drive unit 12, by cables for example, to mechanically steer the drive unit 12, or the steering wheel 82 could be replaced by a tiller.

Additional components of the outboard engine 10 will now be described with reference to FIG. 6.

As can be seen, an engine speed sensor (RPM sensor) 84 is connected to the engine 36. The engine speed sensor 84 senses a speed of rotation of a crankshaft (not shown) of the engine 36 and sends a signal corresponding to this speed to the control unit 76. It is contemplated that the engine speed sensor 84 could alternatively sense a speed of rotation of a flywheel, a counterbalance shaft, or a camshaft (all not shown) of the engine 36 or of the driveshaft 44 or the propeller shaft 46 which either corresponds to the speed of rotation of the engine 36 or can be converted to the speed of rotation of the engine 36.

As can also be seen in FIG. 6, the engine 36 is connected to a throttle body 86. More specifically, the throttle body 86 is connected to an air inlet (not shown) of the engine 36. The throttle body 86 contains a throttle valve (not shown), the position of which controls the amount of air supplied to the engine 36 for combustion. It is contemplated that the engine 36 could be provided with more than one throttle body 86. In an implementation where the engine 36 is a carbureted engine, the throttle body 86 is in the form of a carburetor which is a type of throttle body through which fuel is also supplied to the engine 36. In the present implementation, the position of the throttle valve in the throttle body 84 is controlled by the control unit 76. The control unit 76 receives an input signal from a throttle lever or pedal position sensor, hereinafter a throttle position sensor TPS 88. The throttle position sensor senses a position of a throttle lever or pedal 89 disposed in the boat and which is actuated by the driver of the boat. The throttle lever or pedal 89 can be actuated through a range of throttle request positions from 0 percent throttle request to 100 percent throttle request. When in operation and the throttle lever or pedal 89 is in the 0 percent throttle request position and the throttle valve of the throttle body 86 is in this requested position, the engine 36 is idling. When in operation and the throttle lever is in the 100 percent throttle request position and the throttle valve of the throttle body 86 is in this requested position, the engine 36 is at "wide open throttle". Boats equipped with an outboard engine 10 that can be operated in forward, neutral and reverse can be provided with two distinct levers: one for controlling throttle request and one for switching between forward, neutral and reverse modes of operation. Boats can also be provided with a single throttle lever that controls both throttle request and forward/neutral/reverse. In such single-lever implementations, the throttle lever can be moved forward from a central neutral position to enter the forward mode of operation, and rearward from the central neutral position to enter the reverse mode of operation. Based on the signal received from the throttle position sensor 88 and other signals received from other sensors of the outboard engine 10, such as the engine speed sensor 84, the control unit 76 determines the position that the throttle valve of the throttle body 86 should have and sends a signal to a motor connected to the throttle valve to move the throttle valve to this position. In an alternative implementation, it is contemplated that the throttle lever or pedal 89 could be mechanically linked to the throttle valve of the throttle body 86 such that movement of the throttle lever or pedal 89 moves the throttle valve via a mechanical connection. A throttle valve position sensor (not shown) senses a position of the throttle valve of the throttle body 86 and sends a signal representative of this position to the control unit 76. The control unit 76 uses this signal from the throttle valve position sensor to determine if the throttle valve is in the desired position.

As can also be seen in FIG. 6, a trim angle sensor 90 is connected to the bracket assembly 14. The trim angle sensor 90 has one portion disposed on the swivel bracket 50 and another portion disposed on the stern bracket 52 thereby allowing the trim angle sensor 90 to sense the angle between the brackets 50 and 52, which is indicative of the trim angle of propulsion unit 40. The trim angle sensor 90 sends a signal indicative of the sensed angle to the control unit 76. The control unit 76 uses this signal from the trim angle sensor 90 to determine if the propulsion unit 40 is at the desired trim angle, if the propulsion unit 40 has been trimmed in the desired direction, and if the propulsion unit 40 has reached the full trim in angle, the full trim out angle or the full tilt out angle. It is contemplated that the trim angle sensor 90 could be a different type of sensor. For example, the trim angle sensor 90 could sense the amount by which at least one of the rods 60 of the trim actuators 22 has extended from it corresponding cylinder 58, which can then be converted to a trim angle by the control unit 76.

Although FIG. 6 illustrates a single control unit 76, it is contemplated that the functions of the control unit 76 could be separated between multiple control units. For example, it is contemplated one control unit could be responsible for the functions associated with controlling the tilting, trimming, and steering of the drive unit 12, while another control unit could be responsible for controlling the operation of the engine 36.

Figure 7:
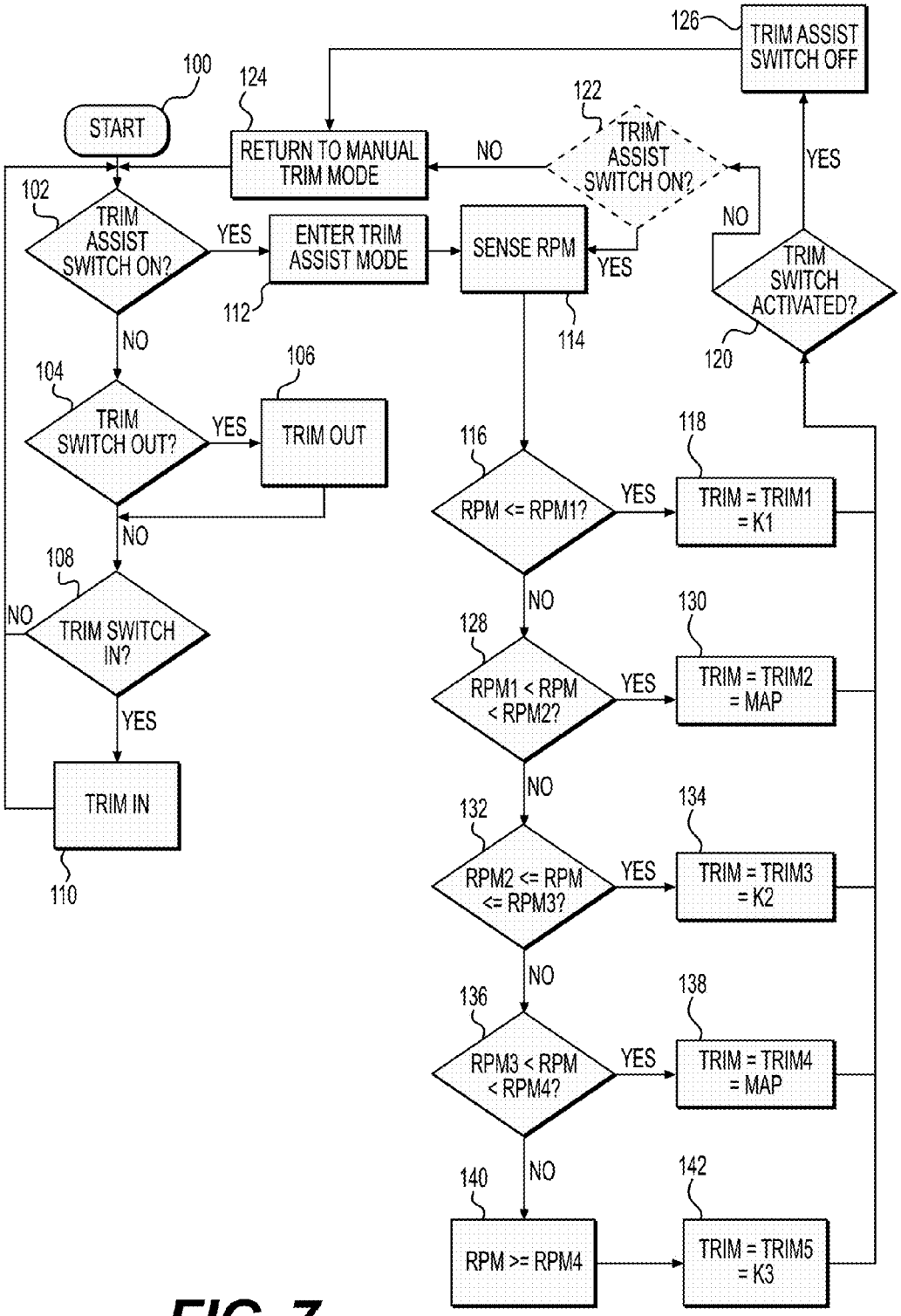
FIG. 7 is a logic diagram illustrating steps of a method for controlling a trim of a propulsion unit of the outboard engine of FIG. 1.
Figure 8:
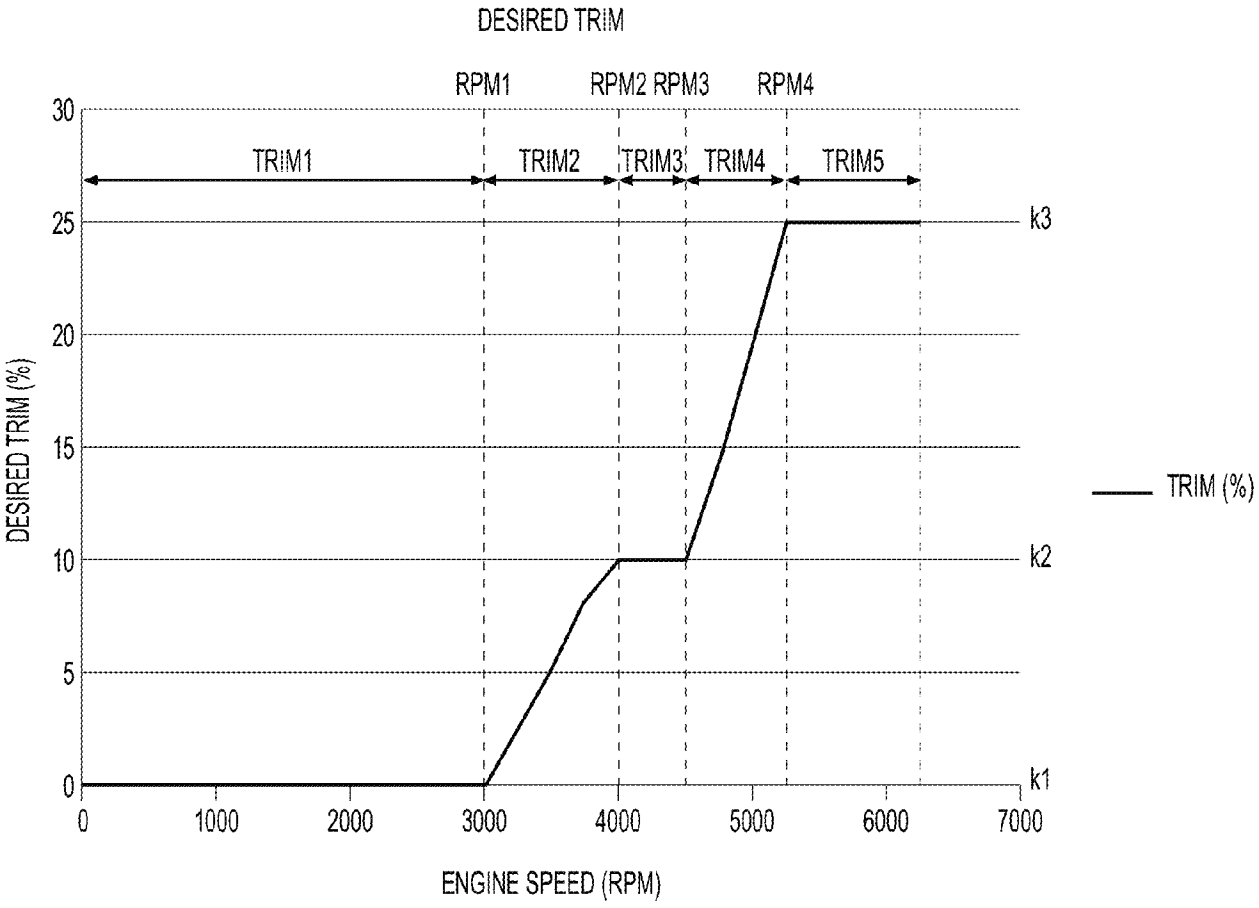
FIG. 8 is a graph illustrating a desired trim of the propulsion unit of the outboard engine of FIG. 1 versus a speed of rotation of the engine of the outboard engine of FIG. 1 according to the method illustrated in FIG. 7.

Turning now to FIGS. 7 and 8, a method for controlling a trim position of the drive unit 12, and therefore of the propulsion unit 40, will be described. The method is initiated at step 100. At step 102, the control unit 76 determines if of the trim assist switch 78 has been activated (i.e. trim assist switch on). If the trim assist switch 78 has not been activated or has been deactivated (i.e. trim assist switch off), the control unit 76 enters (or remains in) a manual trim mode and continues to step 104. It is contemplated that a visual indication of a state of the trim assist switch 78, such as for example a light or icon on a display, could be provided for the driver. At step 104, the control unit 76 determines if the switch 74 is in a trim out position. If the switch 74 is in the trim out position, then at step 106 the control unit 76 sends a signal to the pump 70 to supply hydraulic fluid to the trim actuators 22 to cause the drive unit 12 to trim out. From step 106 or if the switch 74 is not in a trim out position at step 104, the control unit 76 continues to step 108. It is contemplated that at from step 106, the control unit 76 could return to step 102 instead. At step 108, the control unit 76 determines if the switch 74 is in a trim in position. If the switch 74 is in the trim in position, then at step 110 the control unit 76 sends a signal to the pump 70 to supply hydraulic fluid to the trim actuators 22 to cause the drive unit 12 to trim in. From step 110, the control unit 76 returns to step 102. If at step 108, the control unit 76 is not in a trim in position, the control unit 76 returns to step 102 and the drive unit 12 remains at its current trim angle.

If at step 102 the control unit 76 determines that the trim assist switch 78 is activated, the control unit 76 continues to step 112 and enters a trim assist mode. From step 112, the control unit 76 continues to step 114 where it receives a signal from the engine speed sensor 84 that is indicative of the engine speed of the engine 36 that is sensed by the engine speed sensor 84.

Figure 2:
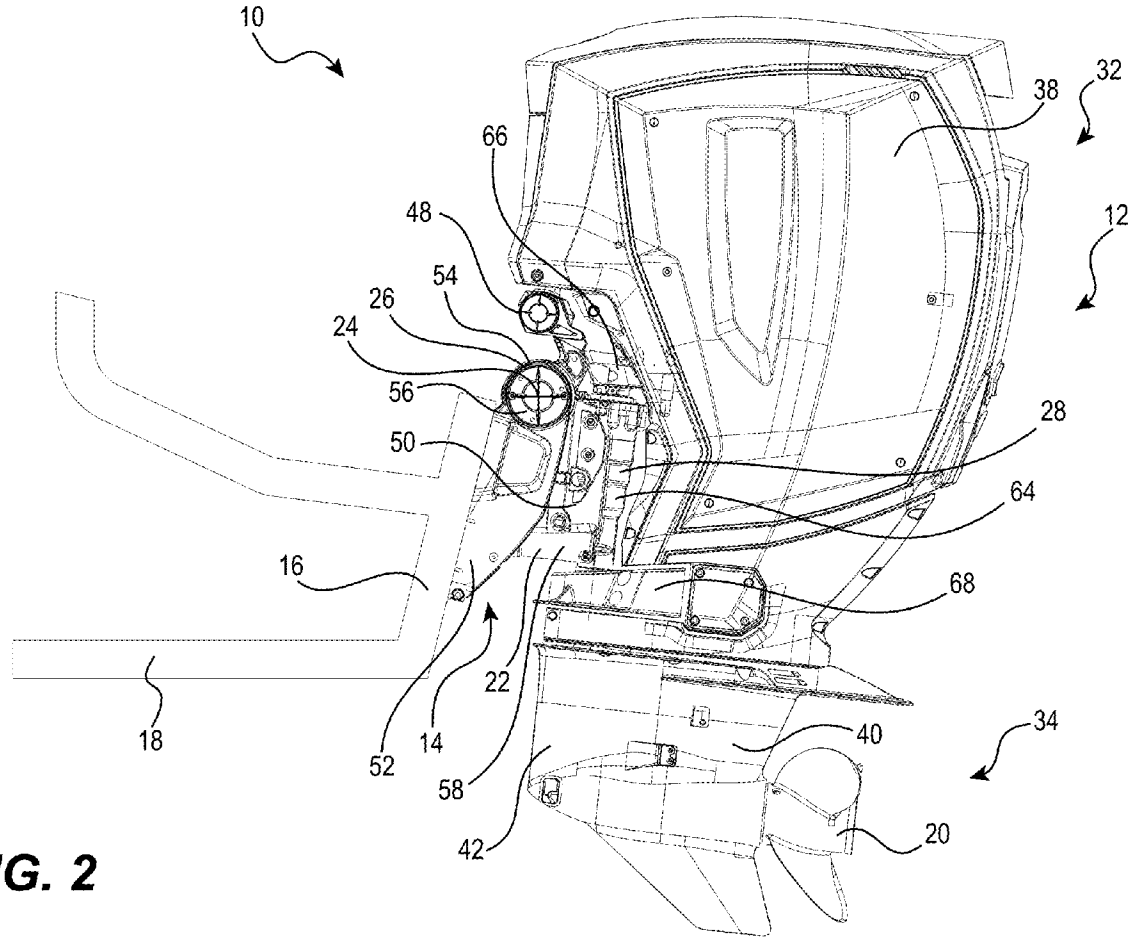
FIG. 2 is a left side elevation view of the outboard engine of FIG. 1 trimmed at a full trim in angle.

From step 114, the control unit 76 continues to step 116 where it compares the engine speed (RPM) sensed at step 114 to a predetermined engine speed RPM1. In the present implementation, as can be seen in FIG. 8, the predetermined engine speed RPM1 is 3000 rpm. In the present implementation, the predetermined engine speed RPM1 is selected to be high enough that many watercraft will have reached an "on plane" condition once they have accelerated to this engine speed. If at step 116 the control unit 76 determines that the engine speed is less than or equal to the predetermined engine speed RPM1, then at step 118 the control unit 76 sends a signal to the pump 70 to position the propulsion unit 40 at a trim angle TRIM1 if the propulsion unit 40 is not already at this trim angle. The trim angle TRIM1 is a constant angle K1. As can be seen in FIG. 8, in the present implementation, the constant angle K1 corresponds to 0 percent of the full range of trim angles. In other words, the constant angle K1 is the full trim in angle and the propulsion unit 40 is in the position illustrated in FIG. 2. As can be seen in FIG. 2, in the present implementation, the full trim in angle is a negative trim angle. When the propulsion unit 40 is at a negative trim angle, the propulsion unit 40 is pointing upwards, that is to say the forward end of the propulsion unit 40 is above its rearward end and the propeller 20. As such, thrust generated by the propeller 20 rotating in a direction to generate a forward thrust, which results in forward motion of the watercraft, also has an upward component. Once the propulsion unit 40 has reached the constant angle K1, as determined from a signal received from the trim angle sensor 90 by the control unit 76, from step 118 the control unit 76 continues to step 120.

At step 120, the control unit 76 determines if the switch 74 has been activated. If at step 120 it is determined that the switch 74 has not been activated, then at step 122, the control unit 76 determines if the trim assist switch 78 is still activated. If at step 122 the trim assist switch 78 is still activated, the control unit 76 returns to step 114. If at step 122 the trim assist switch 78 has been deactivated, then the control unit 76 continues to step 124. At step 124, the control unit 76 returns to the manual trim mode of operation and then returns to step 102. If at step 120 the control unit 76 determines that the switch 74 has been activated, thereby indicating that a manual operation of the trim is desired, then at step 126 the control unit 76 deactivates the trim assist switch 78, returns to the manual trim mode of operation at step 124 and then returns to step 102.

If at step 116 the control unit 76 determines that the engine speed sensed at step 114 is greater than the engine speed RPM1, then the control unit 76 continues to step 128.

At step 128, the control unit compares the engine speed (RPM) sensed at step 114 to the predetermined engine speed RPM1 and to a predetermined engine speed RPM2. In the present implementation, as can be seen in FIG. 8, the predetermined engine speed RPM2 is 4000 rpm. As such, the difference between the predetermined engine speeds RPM1 and RPM2 (i.e. 1000 rpm) is less than the predetermined engine speed RPM1 (i.e. 3000 rpm). If at step 128 the control unit 76 determines that the engine speed is greater than the predetermined engine speed RPM1 and less than the predetermined engine speed RPM2, then at step 130 the control unit 76 sends a signal to the pump 70 to position the propulsion unit 40 at a trim angle TRIM2 if the propulsion unit 40 is not already at this trim angle. The trim angle TRIM2 is obtained from a map providing trim angles for various engine speeds. Should the engine speed be between two values on the map, the control unit 76 determines the trim angle TRIM2 by interpolation. As can be seen in FIG. 8, the value of the trim angle TRIM2 increases as the engine speed increases. It is contemplated that the trim angle TRIM2 could alternatively be determined as a mathematical function of engine speed. As can be seen in FIG. 8, in the present implementation, the trim angle TRIM2 is between 0 percent and 10 percent of the full range of trim angles. In the present implementation, the trim angle TRIM2 is a negative trim angle. Once the propulsion unit 40 has reached the desired trim angle TRIM2, as determined from a signal received from the trim angle sensor 90 by the control unit 76, from step 130 the control unit 76 continues to step 120.

If at step 128 the control unit 76 determines that the engine speed sensed at step 114 is greater than or equal to the predetermined engine speed RPM2, then the control unit 76 continues to step 132.

At step 132, the control unit compares the engine speed (RPM) sensed at step 114 to the predetermined engine speed RPM2 and to a predetermined engine speed RPM3. In the present implementation, as can be seen in FIG. 8, the predetermined engine speed RPM3 is 4500 rpm. As such, the difference between the predetermined engine speeds RPM1 and RPM3 (i.e. 1500 rpm) is less than the predetermined engine speed RPM1 (i.e. 3000 rpm). Also, the difference between the predetermined engine speeds RPM2 and RPM3 (i.e. 500 rpm) is less than the difference between the predetermined engine speeds RPM1 and RPM2 (i.e.

1000 rpm). If at step 132 the control unit 76 determines that the engine speed is greater than or equal to the predetermined engine speed RPM2 and less than or equal to the predetermined engine speed RPM3, then at step 134 the control unit 76 sends a signal to the pump 70 to position the propulsion unit 40 at a trim angle TRIM3 if the propulsion unit 40 is not already at this trim angle. The trim angle TRIM3 is a constant angle K2. As can be seen in FIG. 8, in the present implementation, the constant angle K2 corresponds to 10 percent of the full range of trim angles. In the present implementation, the constant angle K2 is a negative trim angle. In an implementation where the full trim in angle (FIG. 2) is −6 degrees and the full trim out angle (FIG. 4) is 15 degrees, the full range of angles is 21 degrees (i.e. 15−(−6)=21), 10 percent of the full range of trim angles is thus 2.1 degrees, and therefore the constant angle K2 is −3.9 degrees (i.e. (−6)+2.1=(−3.9)). Once the propulsion unit 40 has reached the constant angle K2, as determined from a signal received from the trim angle sensor 90 by the control unit 76, from step 134 the control unit 76 continues to step 120. In the present implementation, the engine speeds RPM2 and RPM3 are selected to provide a stable cruising range therebetween for many watercraft and the constant angle K2 is selected to provide a trim angle that would result in a neutral attitude wherein many watercraft will be in an "on plane" condition and substantially horizontal to the waterline.

If at step 132 the control unit 76 determines that the engine speed sensed at step 114 is greater than the predetermined engine speed RPM3, then the control unit 76 continues to step 136.

At step 136, the control unit compares the engine speed (RPM) sensed at step 114 to the predetermined engine speed RPM3 and to a predetermined engine speed RPM4. In the present implementation, as can be seen in FIG. 8, the predetermined engine speed RPM4 is 5250 rpm. As such, the difference between the predetermined engine speeds RPM1 and RPM4 (i.e. 2250 rpm) is less than the predetermined engine speed RPM1 (i.e. 3000 rpm). Also, the difference between the predetermined engine speeds RPM2 and RPM3 (i.e. 500 rpm) is less than the difference between the predetermined engine speeds RPM3 and RPM4 (i.e. 750 rpm). Also, the difference between the predetermined engine speeds RPM3 and RPM4 (i.e. 750 rpm) is less than the difference between the predetermined engine speeds RPM1 and RPM2 (i.e. 1000 rpm). If at step 136 the control unit 76 determines that the engine speed is greater than the predetermined engine speed RPM3 and less than the predetermined engine speed RPM4, then at step 138 the control unit 76 sends a signal to the pump 70 to position the propulsion unit 40 at a trim angle TRIM4 if the propulsion unit 40 is not already at this trim angle. The trim angle TRIM4 is obtained from a map providing trim angles for various engine speeds. Should the engine speed be between two values on the map, the control unit 76 determines the trim angle TRIM4 by interpolation. As can be seen in FIG. 8, the value of the trim angle TRIM4 increases as the engine speed increases. It is contemplated that the trim angle TRIM4 could alternatively be determined as a mathematical function of engine speed. As can be seen in FIG. 8, in the present implementation, the trim angle TRIM4 is between 10 percent and 25 percent of the full range of trim angles. In the present implementation, the trim angle TRIM4 is a negative trim angle. Once the propulsion unit 40 has reached the desired trim angle TRIM4, as determined from a signal received from the trim angle sensor 90 by the control unit 76, from step 138 the control unit 76 continues to step 120.

If at step 136 the control unit 76 determines that the engine speed sensed at step 114 is not less than the predetermined engine speed RPM4, then the engine speed sensed at step 114 is greater than or equal to the predetermined engine speed RPM4 (step 140) and the control unit 76 continues to step 142. It is contemplated that at step 140, instead of logically determining that the engine speed sensed at step 114 must be greater than or equal to the predetermined engine speed RPM4, the control unit 76 could compare the engine speed sensed at step 114 to the predetermined engine speed RPM4. If in such an alternative implementation of step 140 the control unit 76 determines that the engine speed sensed at step 114 is not greater than or equal to the predetermined speed RPM4, then the control unit 76 determines that there is an error, which could be caused by a malfunction of the trim angle sensor 90 or one or more logic circuits of the control unit 76, and the control unit 76 enters a fault operation mode. In the fault operation mode, the control unit 76 could, for example, take one or more of the following actions: limit an engine speed, lock the trim angle of the propulsion unit 40 to the current trim angle, return to the manual trim mode, and send a signal to a display in the watercraft to indicate to the driver that a trim fault has occurred.

At step 142 the control unit 76 sends a signal to the pump 70 to position the propulsion unit 40 at a trim angle TRIM5, as shown in FIG. 3, if the propulsion unit 40 is not already at this trim angle. The trim angle TRIM5 is a constant angle K3. As can be seen in FIG. 8, in the present implementation, the constant angle K3 corresponds to 25 percent of the full range of trim angles. In the present implementation, the constant angle K3 positions propulsion system 40 such that the propeller shaft 46 is nearly horizontal as can be seen in FIG. 3. In the implementation where the full trim in angle (FIG. 2) is −6 degrees and the full trim out angle (FIG. 4) is 15 degrees, 25 percent of the full range of trim angles is thus 5.25 degrees, and therefore the constant angle K3 is −0.75 degrees (i.e. (−6)+5.25=(−0.75)). Once the propulsion unit 40 has reached the constant angle K3, as determined from a signal received from the trim angle sensor 90 by the control unit 76, from step 142 the control unit 76 continues to step 120. In the present implementation, the constant angle K3 is selected to provide a trim angle that would lift the bow slightly higher than at angle K2 and allow many watercraft to increase their running speed efficiently as the engine accelerates beyond the engine speed RPM4.

As should be understood from the method described above, when the control unit 76 operates in the trim assist mode, the trim position of the drive unit 12, and therefore the propulsion unit 40, is determined independently of the speed of the watercraft and the propulsion unit 40 is trimmed without any input by the driver of the boat via the switch 74.

It should be understood that the values provided above for the full trim in angle, the full trim out angle, the predetermined engine speeds RPM1, RPM2, RPM3 and RPM4, and the constant angles K1, K2 and K3 are only one possible example of these values. Some or all of these values could be varied depending on the hydrodynamic properties of the hull of the watercraft to which the outboard engine 10 is mounted, the height and the angle at which the stern bracket 52 is mounted to the stern 16 of the watercraft, the number of outboard engines 10 mounted to the watercraft, the characteristics of the engine 36, the weight distribution and total weight of the watercraft, and the type of propeller 20 used, only to name a few.

Figure 9:
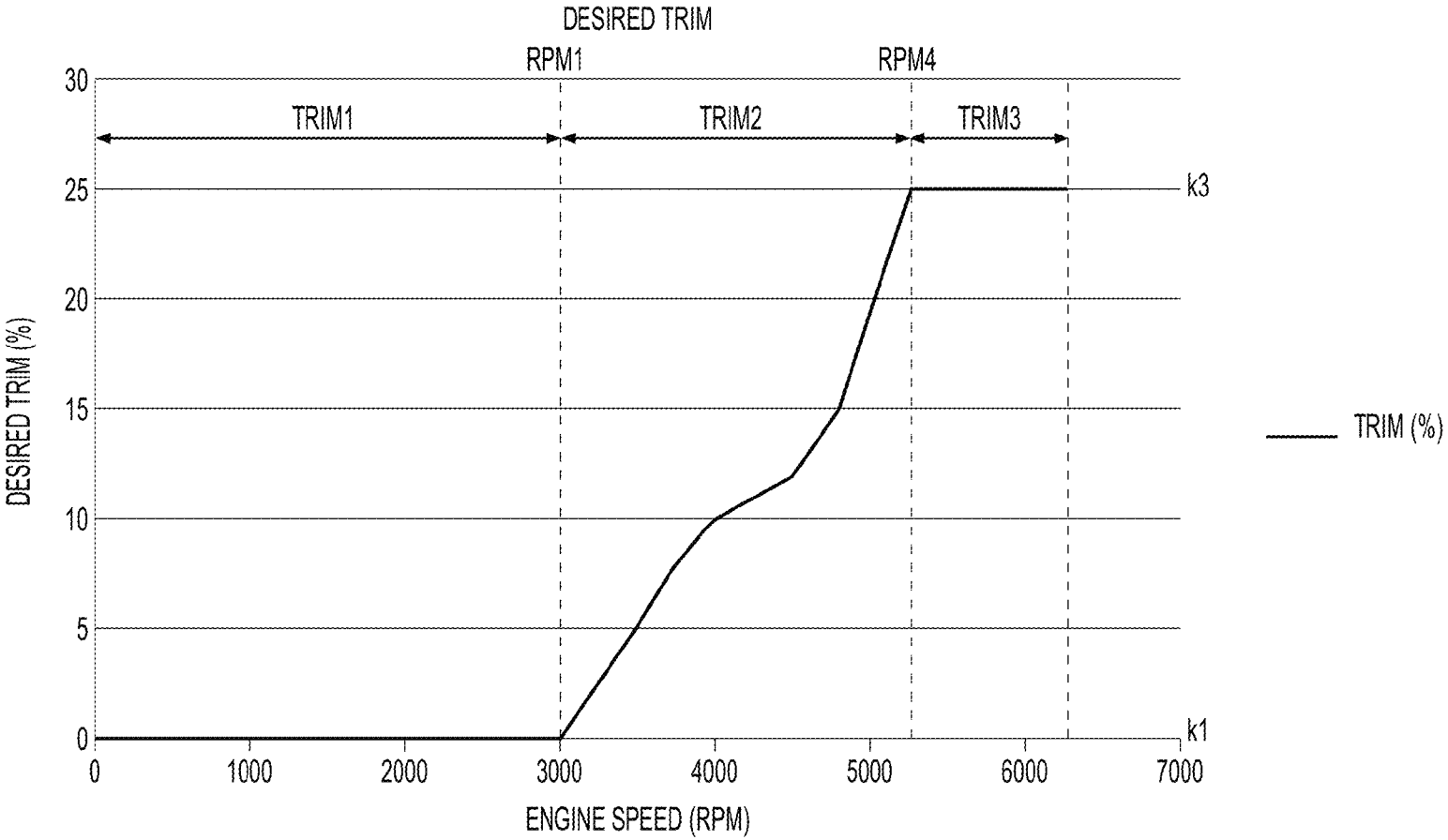
FIG. 9 is a graph illustrating a desired trim of the propulsion unit of the outboard engine of FIG. 1 versus a speed of rotation of the engine of the outboard engine of FIG. 1 according to an alternative implementation of the method illustrated in FIG. 7.

It is contemplated that steps 132 to 138 could be omitted from the method described above with respect to FIG. 7. In such an implementation, at step 128 the control unit 76 determines if the engine speed sensed at step 114 is greater than the predetermined speed RPM1 and less than the predetermined speed RPM4. FIG. 9 illustrates one possible implementation a curve of the desired trim versus engine speed resulting from such a method.

Figure 10:
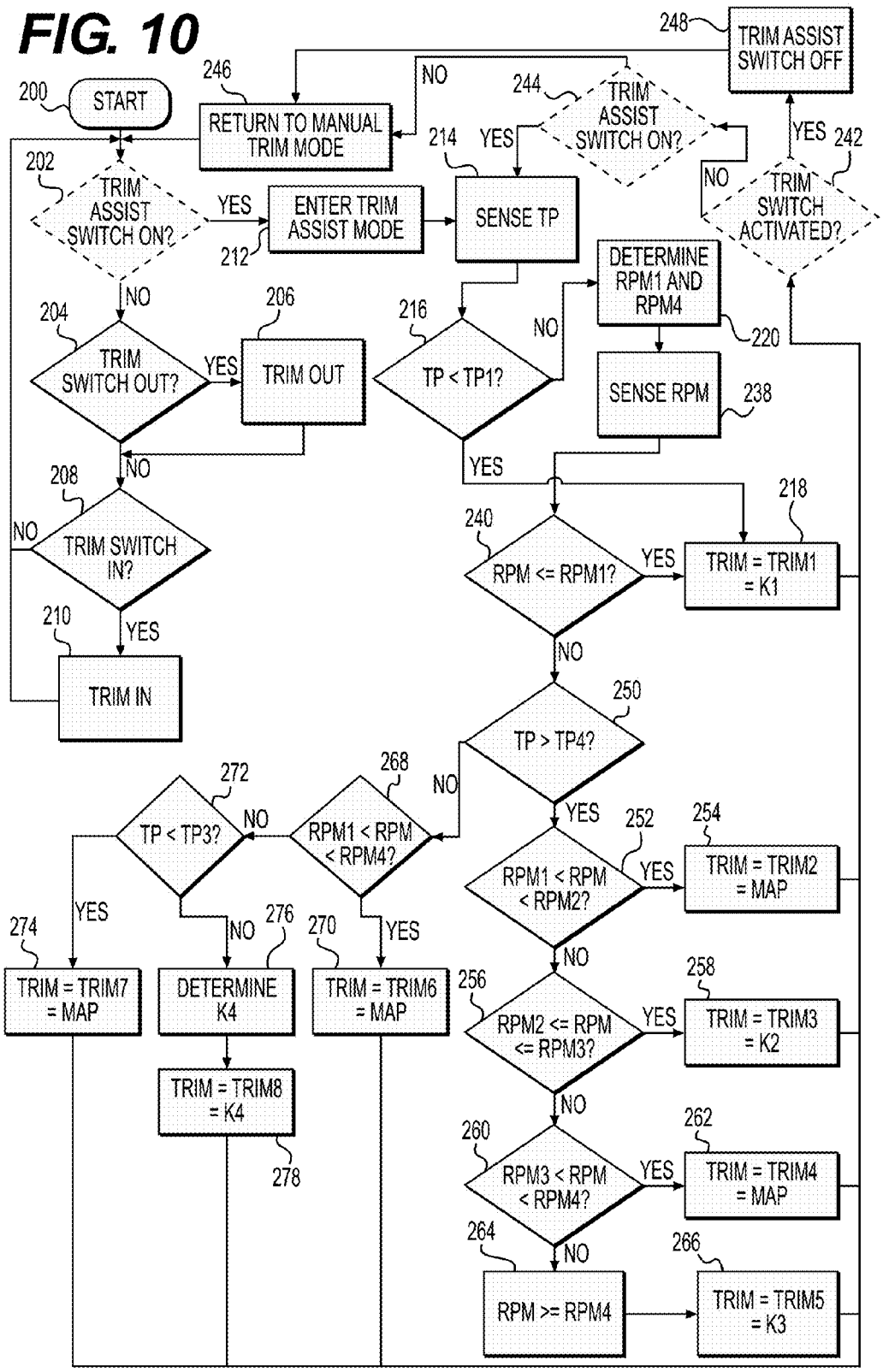
FIG. 10 is a logic diagram illustrating steps of an alternative method for controlling a trim of a propulsion unit of the outboard engine of FIG. 1.
Figure 11:
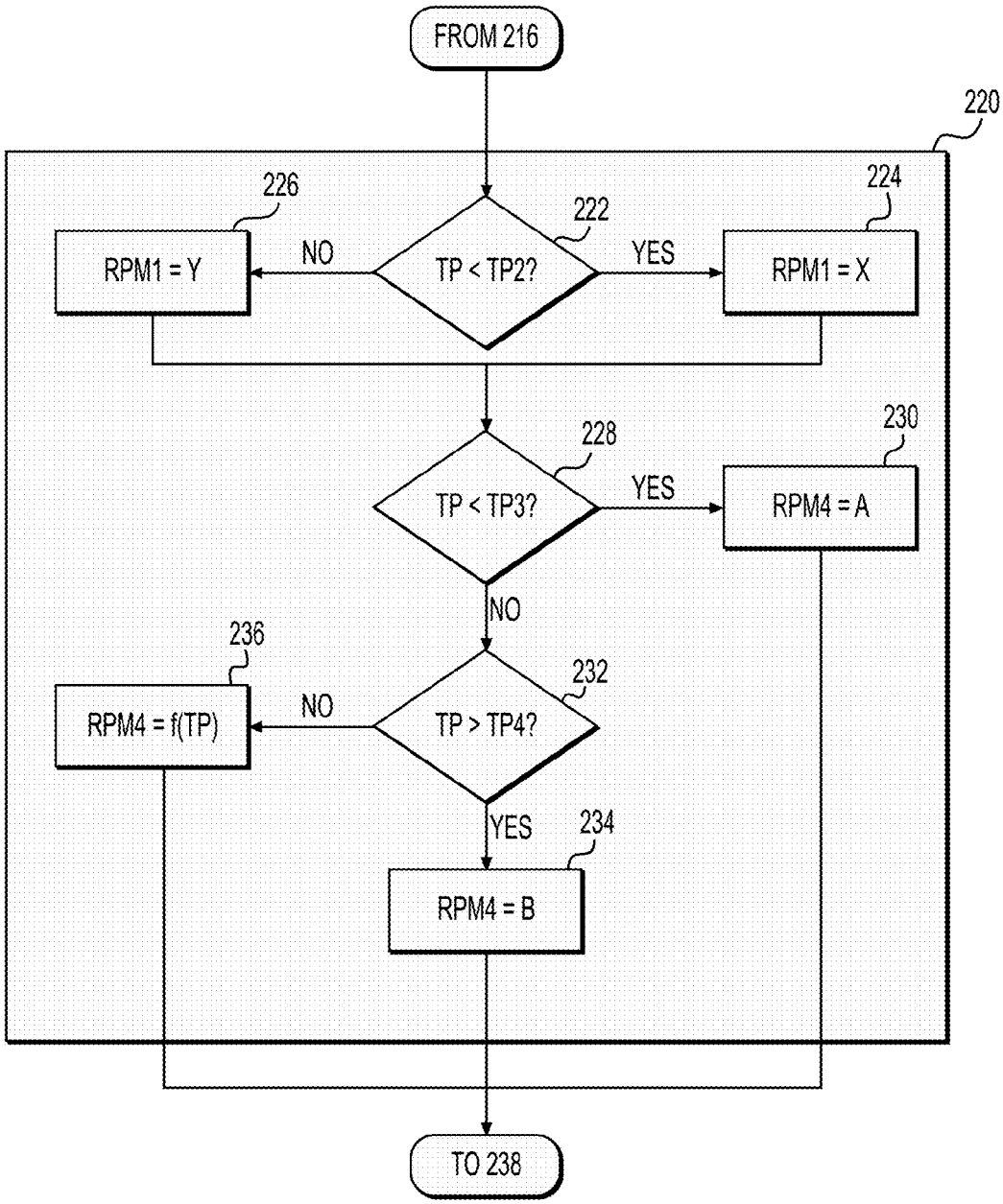
FIG. 11 is a logic diagram illustrating the sub-steps of a step of the method of FIG. 10.
Figure 12:
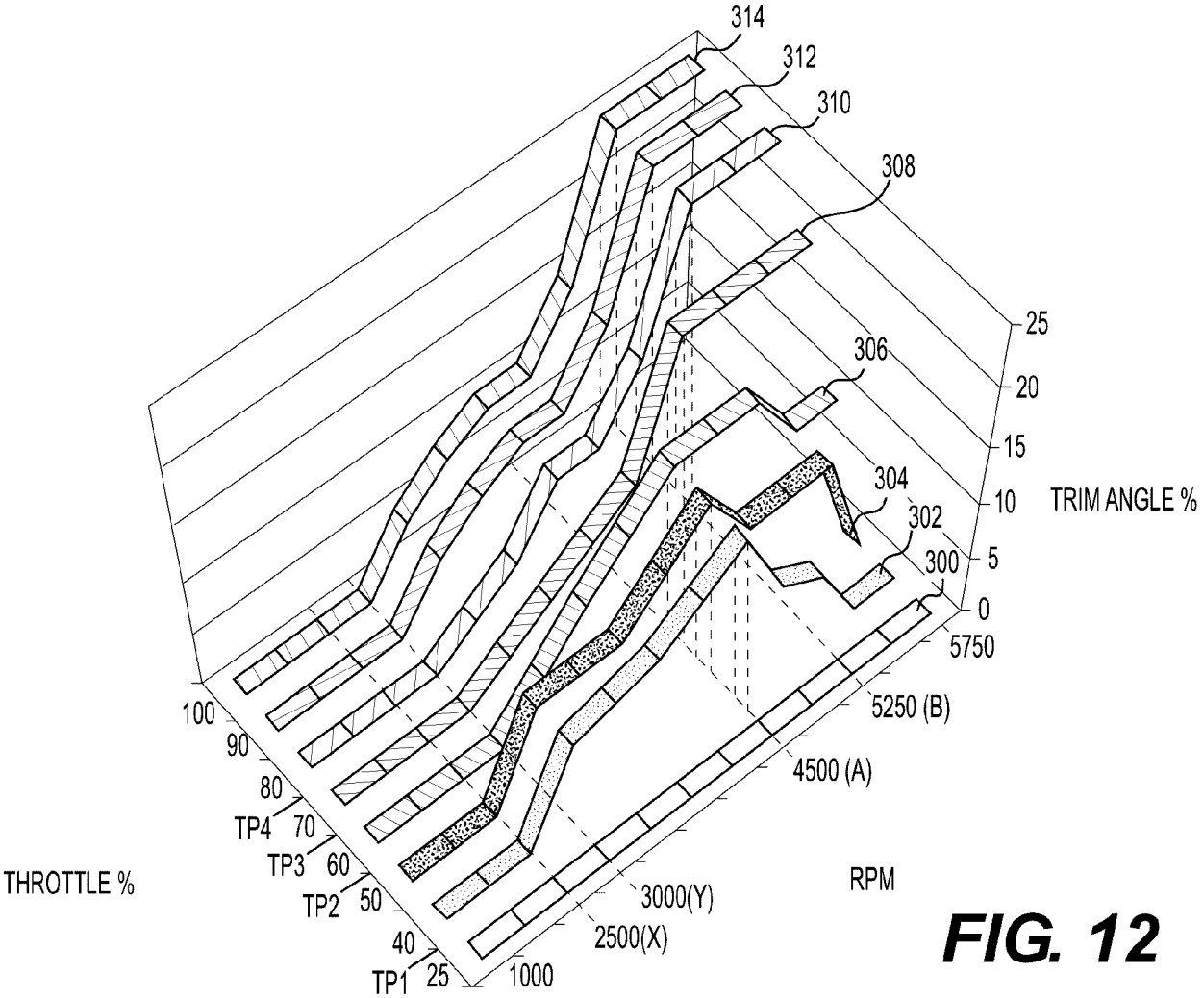
FIG. 12 is a graph illustrating a desired trim of the propulsion unit of the outboard engine of FIG. 1 versus a speed of rotation of the engine and of a throttle position of a throttle lever or pedal of the outboard engine of FIG. 1 according to the method illustrated in FIG. 10.

Turning now to FIGS. 10 to 12, an alternative method for controlling a trim position of the drive unit 12, and therefore of the propulsion unit 40, will be described. The method is initiated at step 200. The method then proceeds to step 202. Steps 202 to 212 correspond to step 102 to 112 described above and will therefore not be described again herein. It should be noted that the increments on the engine speed (RPM) axis and the throttle position (Throttle %) axis of the graph of FIG. 12 are not constant.

From step 212, at step 214 the TPS 88 senses a position of the throttle lever or pedal 89, hereinafter the throttle position TP, and sends a signal representative of this position to the control unit 76. Then at step 216, the control unit 76 determines if the throttle position TP is less than a predetermined throttle position TP1. In the present implementation, as can be seen in FIG. 12, the predetermined throttle position TP1 corresponds to 30 percent of actuation of the throttle lever or pedal 89. 30 percent of throttle actuation corresponds to 30 percent of the full range of throttle positions from the minimum (i.e. idle) throttle position to the maximum throttle position. If at step 216 the control unit 76 determines that the throttle position TP is less than the predetermined throttle position TP1, then, regardless of engine speed, at step 218 the control unit 76 sends a signal to the pump 70 to position the propulsion unit 40 at a trim angle TRIM1 if the propulsion unit 40 is not already at this trim angle. The trim angle TRIM1 is a constant angle K1. As can be seen in FIG. 12 with respect to line 300, in the present implementation, the constant angle K1 corresponds to 0 percent of the full range of trim angles. If at step 216 the control unit 76 determines that the throttle position TP is not less than the predetermined throttle position TP1, then the control unit 76 continues to step 220. It is contemplated that instead of using the throttle position of the throttle lever or pedal 89 as sensed by the TPS 88 for the throttle position TP, that for the above steps and the steps described below using or making reference to the throttle position TP, that the position of the throttle valve of the throttle body 86 as sensed by the throttle valve position sensor could be used as the throttle position TP.

As step 220, the control unit 76 determines the predetermined engine speeds RPM1 and RPM4. In the present implementation, the predetermined engine speeds RPM1 and RPM4 vary depending of the throttle position TP. The steps used to determine the engine speeds RPM1 and RPM4 are illustrated in FIG. 11.

As can be seen in FIG. 11, from step 216, at step 222 the control unit 76 determines if the throttle position TP is less than a predetermined throttle position TP2. In the present implementation, as can be seen in FIG. 12, the predetermined throttle position TP2 corresponds to 55 percent of throttle actuation. If at step 222 the control unit 76 determines that the throttle position TP is less than the predetermined throttle position TP2, then at step 224 the control unit 76 sets the predetermined engine speed RPM1 to a value X. This value of RPM1 applies to lines 302 and 304 in FIG. 12. In the present implementation, the value X corresponds to 2500 RPM. If at step 216 the control unit 76 determines that the throttle position TP is not less than the predetermined throttle position TP2, then at step 226 the control unit 76 sets the predetermined engine speed RPM1 to a value Y. This value of RPM1 applies to lines 306, 308, 310, 312 and 314 in FIG. 12. In the present implementation, the value Y corresponds to 3000 RPM. From steps 224 and 226, the control unit 76 continues to step 228.

At step 228, the control unit 76 determines if the throttle position TP is less than a predetermined throttle position TP3. In the present implementation, as can be seen in FIG. 12, the predetermined throttle position TP3 corresponds to 65 percent of throttle actuation. If at step 228 the control unit 76 determines that the throttle position TP is less than the predetermined throttle position TP3, then at step 230 the control unit 76 sets the predetermined engine speed RPM4 to a value A. This value of RPM4 applies to lines 302, 304 and 306 in FIG. 12. In the present implementation, the value A corresponds to 4500 RPM. From step 230, the control unit continues to step 238. If at step 228 the control unit 76 determines that the throttle position TP is not less than the predetermined throttle position TP3, then the control unit 76 continues to step 232.

At step 232, the control unit 76 determines if the throttle position TP is greater than a predetermined throttle position TP4. In the present implementation, as can be seen in FIG. 12, the predetermined throttle position TP4 corresponds to 75 percent of throttle actuation. If at step 232 the control unit 76 determines that the throttle position TP is greater than the predetermined throttle position TP4, then at step 234 the control unit 76 sets the predetermined engine speed RPM4 to a value B. This value of RPM4 applies to lines 310, 312 and 314 in FIG. 12. In the present implementation, the value B corresponds to 5250 RPM. If at step 232 the control unit 76 determines that the throttle position TP is not greater than the predetermined throttle position TP4, then at step 236 the control unit 76 sets the predetermined engine speed RPM4 to a value determined as a function of throttle position f(TP). This value of RPM4 applies to line 308 in FIG. 12. In the present implementation, the function f(TP) is an interpolation between the engine speed A at the throttle position TP3 and the engine speed B at the throttle position TP4. From steps 234 and 236, the control unit 76 continues to step 238.

At step 238, the control unit 76 receives a signal from the engine speed sensor 84 that is indicative of the engine speed of the engine 36 that is sensed by the engine speed sensor 84.

From step 238, the control unit 76 continues to step 240 where it compares the engine speed (RPM) sensed at step 238 to the predetermined engine speed RPM1 determined at step 220. If at step 240 the control unit 76 determines that the engine speed is less than or equal to the predetermined engine speed RPM1, then at step 218 the control unit 76 sends a signal to the pump 70 to position the propulsion unit 40 at the trim angle TRIM1 if the propulsion unit 40 is not already at this trim angle as indicated above. Once the propulsion unit 40 has reached the constant angle K1, as determined from a signal received from the trim angle sensor 90 by the control unit 76, from step 218 the control unit 76 continues to step 242.

At step 242, the control unit 76 determines if the switch 74 has been activated. If at step 242 it is determined that the switch 74 has not be activated, then at step 244, the control unit 76 determines if the trim assist switch 78 is still activated. If at step 244 the trim assist switch 78 is still activated, the control unit 76 returns to step 214. If at step 244 the trim assist switch 78 has been deactivated, then the control unit 76 continues to step 246. At step 246, the control unit 76 returns to the manual trim mode of operation and then returns to step 202. If at step 242 the control unit 76 determines that the switch 74 has been activated, thereby indicating that a manual operation of the trim is desired, then at step 248 the control unit 76 deactivates the trim assist switch 78, returns to the manual trim mode of operation at step 246 and then returns to step 202.

If at step 240 the control unit 76 determines that the engine speed sensed at step 238 is greater than the engine speed RPM1 determined at step 220, then the control unit 76 continues to step 250.

At step 250, the control unit 76 determines if the throttle position is greater than TP4. If at step 250 the throttle position is greater than TP4, which corresponds to lines 310, 312 and 314, then the control unit 76 proceeds to step 252. Step 252 and the following steps 254, 256, 258, 260, 262, 264 and 266 correspond to steps 128, 130, 132, 134, 136, 138, 140 and 142 respectively, but using the values of RPM1 and RPM4 determined at step 220. As such, steps 252, 254, 256, 258, 260, 262, 264 and 266 will not be described herein. From steps 254, 258, 262 and 266, the control unit 76 continues to step 242.

If at step 250 the throttle position is less than or equal to TP4, the control unit 76 continues to step 268. At step 268, the control unit 76 determines if the engine speed RPM is between the predetermined engine speeds RPM1 and RPM4 determined at step 220. If at step 268 the engine speed RPM is between the predetermined engine speeds RPM1 and RPM4, then at step 270 the control unit 76 sends a signal to the pump 70 to position the propulsion unit 40 at a trim angle TRIM6 if the propulsion unit 40 is not already at this trim angle. The trim angle TRIM6 is obtained from a map providing trim angles for various engine speeds and throttle positions. Should the engine speed or throttle position be between two values on the map, the control unit 76 determines the trim angle TRIM6 by interpolation. In the implementation illustrated in FIG. 12, the value of the trim angle TRIM 6 is selected from lines 302, 304, 306 or 308 between the predetermined engine speed RPM1 (X or Y as determined from step 220) and the predetermined engine speed RPM4 (A or B as determined from step 220), and as can be seen the value of the trim angle TRIM6 increases as the engine speed increases. It is contemplated that the trim angle TRIM6 could alternatively be determined as a mathematical function of engine speed and throttle position. In the present implementation, the trim angle TRIM6 is a negative trim angle. Once the propulsion unit 40 has reached the desired trim angle TRIM6, as determined from a signal received from the trim angle sensor 90 by the control unit 76, from step 270 the control unit 76 continues to step 242.

If at step 268 the engine speed RPM is greater than or equal to the predetermined engine speed RPM4, then at step 272 the control unit 76 determines if the throttle position TP is less than the predetermined throttle position TP3. If at step 272 the control unit 76 determines that the throttle position TP is less than the predetermined throttle position TP3, then at step 274 the control unit 76 sends a signal to the pump 70 to position the propulsion unit 40 at a trim angle TRIM7 if the propulsion unit 40 is not already at this trim angle. The trim angle TRIM7 is obtained from a map providing trim angles for various engine speeds and throttle positions. Should the engine speed or throttle position be between two values on the map, the control unit 76 determines the trim angle TRIM7 by interpolation. In the implementation illustrated in FIG. 12, the value of the trim angle TRIM 7 is selected from lines 302, 304, or 306 at and above the predetermined engine speed RPM4 (i.e. A RPM). As can be seen in FIG. 12, the value of the trim angle TRIM7 can be constant over certain ranges of engine speeds, but generally decreases as the engine speed increases. It is contemplated that the trim angle TRIM7 could alternatively be determined as a mathematical function of engine speed and throttle position. In the present implementation, the trim angle TRIM7 is a negative trim angle. Once the propulsion unit 40 has reached the desired trim angle TRIM7, as determined from a signal received from the trim angle sensor 90 by the control unit 76, from step 274 the control unit 76 continues to step 242.

If at step 272 the control unit 76 determines that the throttle position TP is greater than or equal to the predetermined throttle position TP3, then at step 276 the control unit 76 determines the value of a trim angle K4. The trim angle K4 is a constant trim angle for a given throttle position at or above the predetermined engine speed RPM4 as determined at step 220 for throttle positions at or above the throttle position TP3 and less than or equal to the throttle position TP4. In the implementation shown in FIG. 12, this corresponds to the portion of line 308 that has a constant trim angle of 20 percent of the full range of trim angles. The value of the trim angle K4 is interpolated based on the throttle position TP between a trim angle of 15 percent of the full range of trim angles at a 60 percent throttle position and a trim angle of 25 percent at an 80 percent throttle position. Once the trim angle K4 has been determined, then at step 278 the control unit 76 sends a signal to the pump 70 to position the propulsion unit 40 at a trim angle TRIM5 corresponding to the trim angle K4 if the propulsion unit 40 is not already at this trim angle. Once the propulsion unit 40 has reached the constant angle K4, as determined from a signal received from the trim angle sensor 90 by the control unit 76, from step 278 the control unit 76 continues to step 242.

As can be seen in the graph of FIG. 12, as a result of the above method, once the trim assist mode as been activate by the driver (step 212), from the watercraft at rest, the driver can set the throttle lever or pedal 89 at a throttle position of TP3 or more to get on plane which, depending on the various factors mentioned above, should occur once the engine 36 is at an engine speed of around Y RPM, and once on plane can reduce the degree of actuation of the throttle lever or pedal 89 to a throttle position below the position TP3 which will result in the control unit 76 automatically increasing the trim angle while the engine speed can be maintained. As such, once on plane the engine 36 can be operated more efficiently due to the automatic operation of the trim angle by the control unit 76.

It is contemplated that at least some of the steps in the methods described above could be performed in an order different from the one described above. It should be understood that as a result of this change of order of the steps, the logic used in some of the comparison steps may need to be modified. For example, a step that determines if a value is less than a certain predetermined value as described in the methods above may, as a result of a change of order of the steps, need to determine if the value is greater than or equal to the certain predetermined value.

Figure 13:
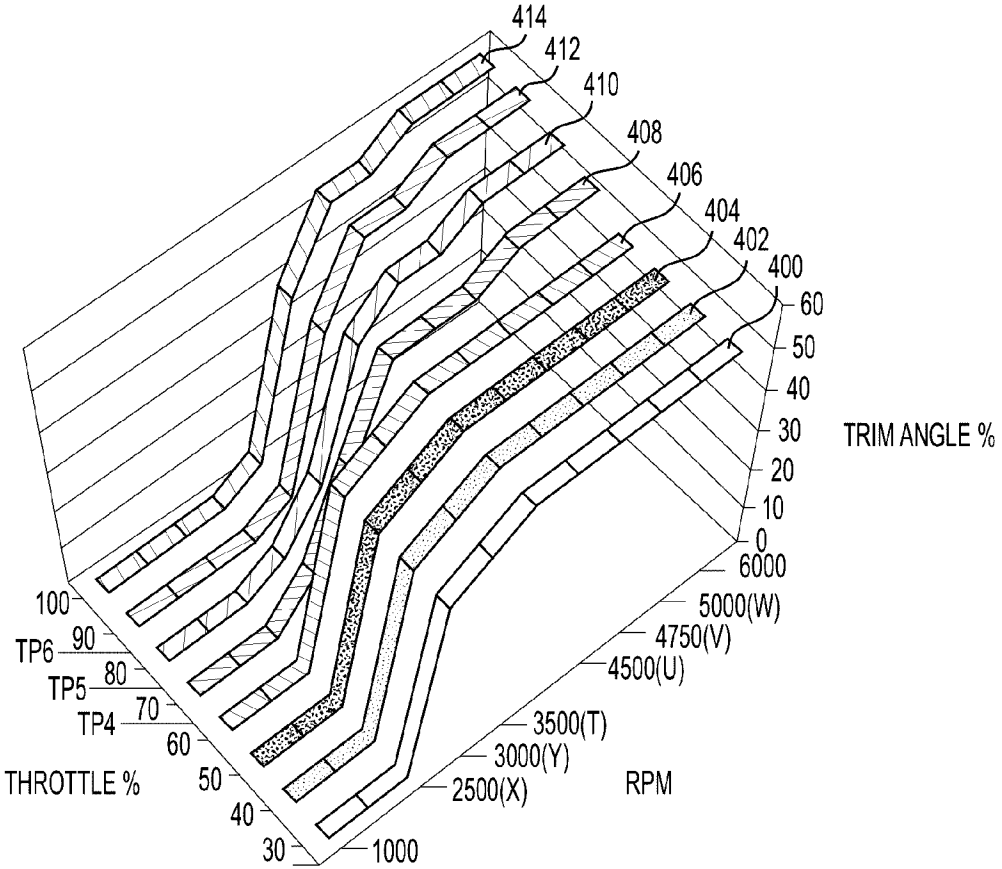
FIG. 13 is a graph illustrating a desired trim of the propulsion unit of the outboard engine of FIG. 1 versus a speed of rotation of the engine and of a throttle position of a throttle lever or pedal of the outboard engine of FIG. 1 according to an alternative implementation of the method illustrated in FIG. 10.

FIG. 13 illustrates a desired trim of the propulsion unit versus a speed of rotation of the engine 36 and of a throttle position of a throttle lever or pedal 89 resulting from an alternative implementation of the method described above with respect to FIGS. 10 to 12. In the description provided below, the values for throttle position, engine speed and trim percentage are provided in brackets. However, it should be understood that other values are contemplated and that these values may vary depending on the specific outboard engine and/or boat being used. It should be noted that the increments on the engine speed (RPM) axis of the graph of FIG. 13 are not constant.

In this implementation, for throttle positions below a predetermined throttle position TP4 (65%), which corresponds to lines 400, 402, 404, and 406, the trim position is constant (0% trim) up to the predetermined engine speed X (2500 RPM). From the predetermined engine speed X up to the predetermined engine T (3500 RPM), the trim increases as the engine speed increases. At and above the predetermined engine speed T, the trim remains constant (50% trim).

For throttle positions above the predetermined throttle position TP4 (65%) and below the predetermined throttle position TP5 (75%), which corresponds to line 408, the trim position is constant (0% trim) up to the predetermined engine speed X (2500 RPM). From the predetermined engine speed X up to the predetermined engine T (3500 RPM), the trim increases as the engine speed increases, but according to a different function than lines 400, 402, 404 and 406. At and above the predetermined engine speed T and up to the predetermined engine speed V (4750 RPM), the trim remains constant (50% trim). From the predetermined engine speed V up to the predetermined engine speed W (5000 RPM), the trim increases as the engine speed increases. At and above the predetermined engine speed W, the trim remains constant (55% trim).

For throttle positions above the predetermined throttle position TP5 (75%) and below the predetermined throttle position TP6 (85%), which corresponds to line 410, the trim position is constant (0% trim) up to the predetermined engine speed X (2500 RPM). From the predetermined engine speed X up to the predetermined engine U (4500 RPM), the trim increases as the engine speed increases. At and above the predetermined engine speed U and up to the predetermined engine speed V (4750 RPM), the trim remains constant (50% trim). From the predetermined engine speed V up to the predetermined engine speed W (5000 RPM), the trim increases as the engine speed increases. At and above the predetermined engine speed W, the trim remains constant (55%).

For throttle positions above the predetermined throttle position TP6 (85%), which corresponds to lines 412 and 414, the trim position is constant (0% trim) up to the predetermined engine speed Y (3000 RPM). From the predetermined engine speed Y up to the predetermined engine U (4500 RPM), the trim increases as the engine speed increases. At and above the predetermined engine speed U and up to the predetermined engine speed V (4750 RPM), the trim remains constant (50% trim). From the predetermined engine speed V up to the predetermined engine speed W (5000 RPM), the trim increases as the engine speed increases. At and above the predetermined engine speed W, the trim remains constant (55%).

Modifications and improvements to the above-described implementations of the present technology may become apparent to those skilled in the art. The foregoing description is intended to be exemplary rather than limiting. The scope of the present technology is therefore intended to be limited solely by the scope of the appended claims.

What is claimed is:

1. A method for controlling a trim position of a marine propulsion unit for propelling a watercraft, the marine propulsion unit being driven by an engine, the method comprising:

sensing an engine speed;

positioning the marine propulsion unit at a first trim angle when the engine speed is less than or equal to a first predetermined engine speed, the first trim angle being constant;

determining a second trim angle at which the marine propulsion unit is to be positioned when the engine speed is greater than the first predetermined engine speed and less than a second predetermined engine speed, the second trim angle increasing as the engine speed increases, the second trim angle being determined independently of a speed of the watercraft, the second trim angle being greater than the first trim angle, the second predetermined engine speed being greater than the first predetermined engine speed;

positioning the marine propulsion unit at the second trim angle when the engine speed is greater than the first predetermined engine speed and less than the second predetermined engine speed; and positioning the marine propulsion unit at a third trim angle when the engine speed is greater than or equal to the second predetermined engine speed, the third trim angle being constant, the third trim angle being greater than the second trim angle.

2. The method of claim 1, wherein the first trim angle is a full trim in angle.

3. The method of claim 2, wherein the third trim angle is less than a full trim out angle.

4. The method of claim 1, wherein a difference between the second predetermined engine speed and the first predetermined engine speed is less than the first predetermined engine speed.

5. The method of claim 1, wherein positioning the marine propulsion unit at the third trim angle when the engine speed is greater than or equal to the second predetermined engine speed includes:

positioning the marine propulsion unit at the third trim angle when the engine speed is greater than or equal to the second predetermined engine speed and less than or equal to a third predetermined engine speed, the third predetermined engine speed being greater than the second predetermined engine speed;

the method further comprising:

positioning the marine propulsion unit at a fourth trim angle when the engine speed is greater than the third predetermined engine speed and less than a fourth predetermined engine speed, the fourth trim angle increasing as the engine speed increases, the fourth trim angle being independent of the speed of the watercraft, the fourth trim angle being greater than the third trim angle.

6. The method of claim 5, further comprising positioning the marine propulsion unit at a fifth trim angle when the engine speed is greater than or equal to the fourth predetermined engine speed, the fifth trim angle being constant, the fifth trim angle being greater than the fourth trim angle.

7. The method of claim 6, wherein the first trim angle is a full trim in angle.

8. The method of claim 7, wherein the fifth trim angle is less than a full trim out angle.

9. The method of claim 8, wherein the fifth trim angle is at an angle from the full trim in angle corresponding to 25 percent of a difference between the full trim out angle and the full trim in angle.

10. The method of claim 6, wherein a difference between the fourth predetermined engine speed and the first predetermined engine speed is less than the first predetermined engine speed.

11. The method of claim 10, wherein a difference between the third predetermined engine speed and the second predetermined engine speed is less than a difference between the second predetermined engine speed and the first predetermined engine speed.

12. The method of claim 10, wherein a difference between the third predetermined engine speed and the second predetermined engine speed is less than a difference between the fourth predetermined engine speed and the third predetermined engine speed.

13. The method of claim 1, further comprising sensing a throttle position; and wherein the first predetermined engine speed has a first value when the throttle position is less than a first predetermined throttle position and has a second value when the throttle position is greater than the first predetermined throttle position, the first value being less than the second value.

14. The method of claim 13, wherein the second predetermined engine speed varies based on the throttle position.

15. The method of claim 1, wherein the first trim angle is constant, the second trim angle is greater than the first trim angle, the second predetermined engine speed is greater than the first predetermined engine speed, the third trim angle is constant, and the third trim angle is greater than the second trim angle for a constant throttle position.

16. The method of claim 1, further comprising:

determining if a trim assist mode has been entered;

controlling the trim position of the marine propulsion unit in the trim assist mode when the trim assist mode has been entered, controlling the trim position of the marine propulsion unit in the trim assist mode including the steps of sensing the engine speed, positioning the marine propulsion unit at the first trim angle, determining the second trim angle, positioning the marine propulsion unit at the second trim angle, and positioning the marine propulsion unit at the third trim angle; and controlling the trim position of the marine propulsion unit in a manual trim mode when the trim assist mode has not been entered, controlling the trim position of the marine propulsion unit in the manual trim mode including changing the trim angle of the marine propulsion unit based on at least one signal received from at least one trim controller.

17. The method of claim 16, further comprising switching from controlling the trim position of the marine propulsion unit in the trim assist mode to controlling the trim position of the marine propulsion unit in the manual trim mode when the at least one signal is received from the at least one trim controller while in the trim assist mode.

18. The method of claim 17, wherein, after switching from controlling the trim position of the marine propulsion unit in the trim assist mode to controlling the trim position of the marine propulsion unit in the manual trim mode when the at least one signal is received from the at least one trim controller while in the trim assist mode, the trim position of the marine propulsion unit continues to be controlled in the manual trim mode until the trim assist mode is entered again.

19. The method of claim 1, further comprising:

sensing a throttle position; and positioning the marine propulsion unit at a fourth trim angle when the engine speed is greater than a third predetermined and the throttle position is less than a predetermined throttle position, the fourth trim angle generally decreasing as the engine speed increases;

wherein a trim angle of the marine propulsion unit generally increases as the engine speed increases when the engine speed is greater than the third predetermined and the throttle position is greater than the predetermined throttle position.

20. A system for controlling a trim position of a marine propulsion unit for propelling a watercraft, the marine propulsion unit being driven by an engine, the unit comprising:

a trim actuator adapted to be operatively connected to the marine propulsion unit;

a control unit electronically connected to the trim actuator for controlling the trim actuator; and an engine speed sensor electronically connected to the control unit, the engine speed sensor sensing an engine speed, the control unit controlling the trim actuator to:

position the marine propulsion unit at a first trim angle when the engine speed sensed by the engine speed sensor is less than or equal to a first predetermined engine speed, the first trim angle being constant;

position the marine propulsion unit at a second trim angle when the engine speed sensed by the engine speed sensor is greater than the first predetermined engine speed and less than a second predetermined engine speed, the second trim angle increasing as the engine speed increases, the second trim angle being determined by the control unit based on engine speed and independently of a speed of the watercraft, the second trim angle being greater than the first trim angle, the second predetermined engine speed being greater than the first predetermined engine speed; and position the marine propulsion unit at a third trim angle when the engine speed sensed by the engine speed sensor is greater than or equal to the second predetermined engine speed, the third trim angle being constant, the third trim angle being greater than the second trim angle.

21. The system of claim 20, further comprising a trim angle sensor electronically connected to the control unit, the trim angle sensor sensing a trim angle of the marine propulsion unit.

22. The system of claim 20, wherein the first trim angle is a full trim in angle.

23. The system of claim 22, wherein the third trim angle is less than a full trim out angle.

24. The system of claim 20, wherein the control unit controls the trim actuator to:

position the marine propulsion unit at the third trim angle when the engine speed sensed by the engine speed sensor is greater than or equal to the second predetermined engine speed and less than or equal to a third predetermined engine speed, the third predetermined engine speed being greater than the second predetermined engine speed;

position the marine propulsion unit at a fourth trim angle when the engine speed sensed by the engine speed sensor is greater than the third predetermined engine speed and less than a fourth predetermined engine speed, the fourth trim angle increasing as the engine speed increases, the fourth trim angle being independent of the speed of the watercraft, the fourth trim angle being greater than the third trim angle; and position the marine propulsion unit at a fifth trim angle when the engine speed sensed by the engine speed sensor is greater than or equal to the fourth predetermined engine speed, the fifth trim angle being constant, the fifth trim angle being greater than the fourth trim angle.

* * * * *